US005286910A

United States Patent [19]

Hasebe

[11] Patent Number: 5,286,910

[45] Date of Patent: Feb. 15, 1994

[54] ELECTRONIC MUSICAL INSTRUMENT HAVING AUTOMATIC CHANNEL-ASSIGNING FUNCTION

[75] Inventor: Masahiko Hasebe, Hamamatsu, Japan

[73] Assignee: Yamaha Corporation, Hamamatsu, Japan

[21] Appl. No.: 937,350

[22] Filed: Aug. 27, 1992

[30] Foreign Application Priority Data

Aug. 30, 1991 [JP] Japan ..... 3-220559

[51] Int. Cl.[5] ..... G10H 1/057; G10H 1/22; G10H 1/36

[52] U.S. Cl. ..... 84/609; 84/618; 84/627; 84/DIG. 2

[58] Field of Search ..... 84/609-614, 84/618, 627, 634-638, 649-652, 656, 663, 684, 702, 703, 712-717, DIG. 2, DIG. 12, DIG. 22

[56] References Cited

U.S. PATENT DOCUMENTS 4,706,538 11/1987 Yoshida ..... 84/DIG. 2
5,042,355 8/1991 Kozuki ..... 84/618

FOREIGN PATENT DOCUMENTS 62-135892 6/1987 Japan .

*Primary Examiner*—Stanley J. Witkowski
*Attorney, Agent, or Firm*—Spensley Horn Jubas & Lubitz

[57] ABSTRACT

An electronic musical instrument provides plural channels from which manual-performance sounds and/or automatic-performance sounds (e.g., automatic-accompaniment sounds) are generated. Herein, the manual-performance sound is designated by a performance manually made by a performer, while the automatic-performance sound is designated on the basis of automatic-performance information which is stored in a memory or the like in advance. Normally, a new musical tone is assigned to an unoccupied channel which is not occupied with a tone generation, so that the new musical tone will be generated from the unoccupied channel. However, under a full-channel condition where all of the channels are occupied with the tone generation, a new manual-performance sound is assigned to one of the channels whose envelope value is the smallest. If a new automatic-performance sound is designated under the full-channel condition, this new automatic-performance sound is assigned to one of the channels occupied with the tone generation of the automatic-performance sounds which receives a key-off command and of which envelope value is the smallest. If it fails to detect such channel, the new automatic-performance sound is assigned to one of the channels occupied with the tone generation of the manual-performance sounds which receives a key-off command but sustains to generate the manual-performance sound. Thus, each of the manual-performance sounds and automatic-performance sounds can be smoothly and automatically assigned to an appropriate one of the channels.

8 Claims, 18 Drawing Sheets

(OVERALL CONFIGURATION OF ELECTRONIC MUSICAL INSTRUMENT)

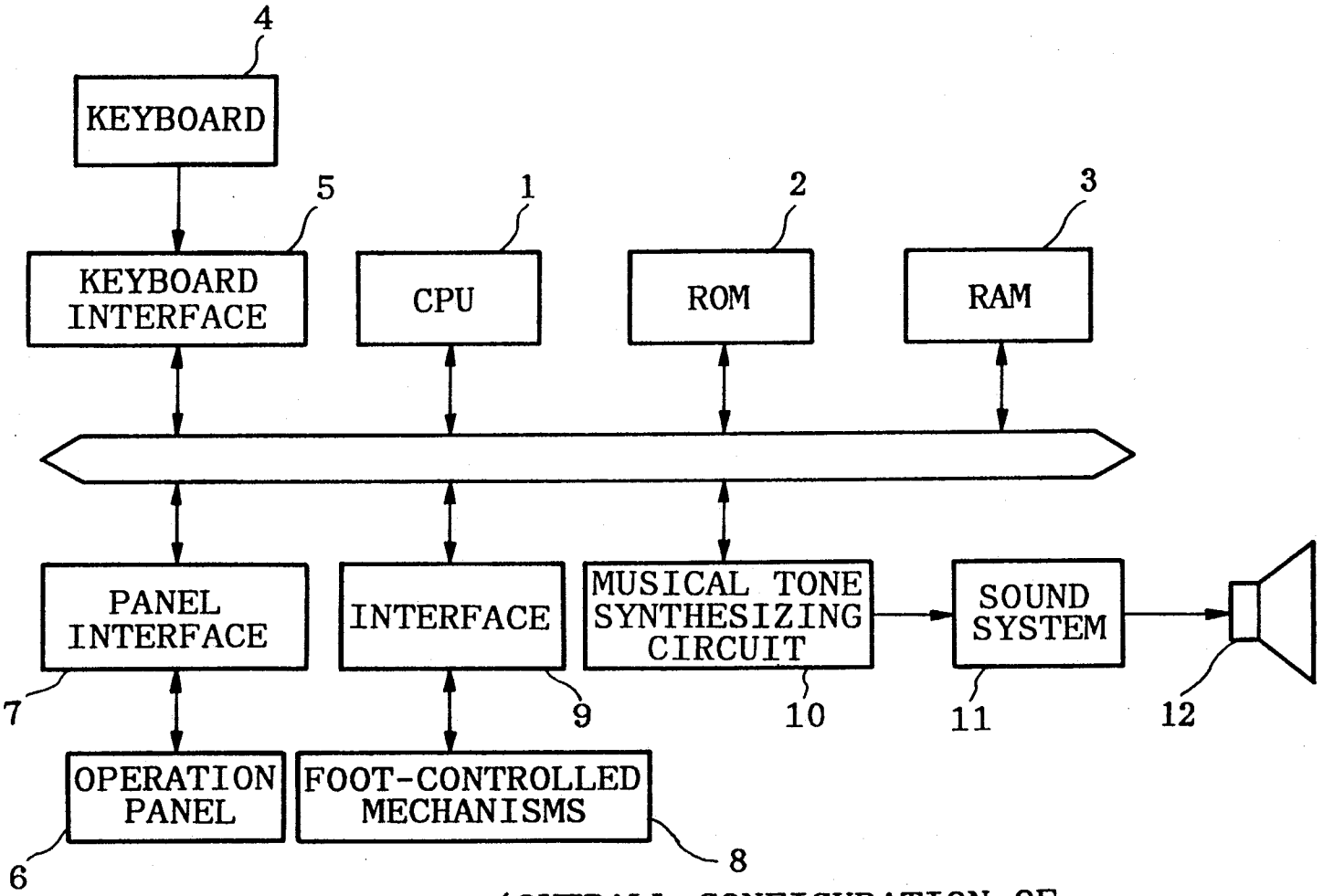
FIG. 1 (OVERALL CONFIGURATION OF ELECTRONIC MUSICAL INSTRUMENT)

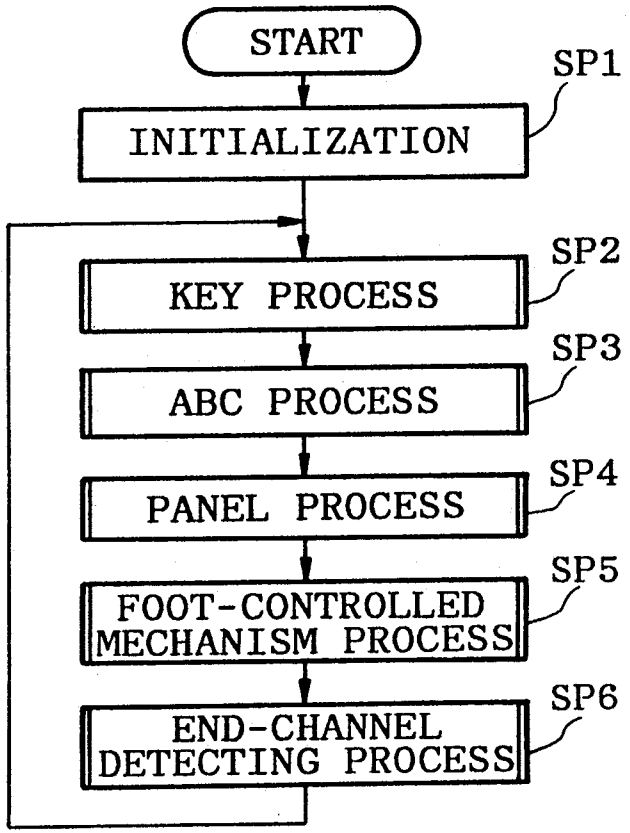
FIG.2(MAIN ROUTINE)
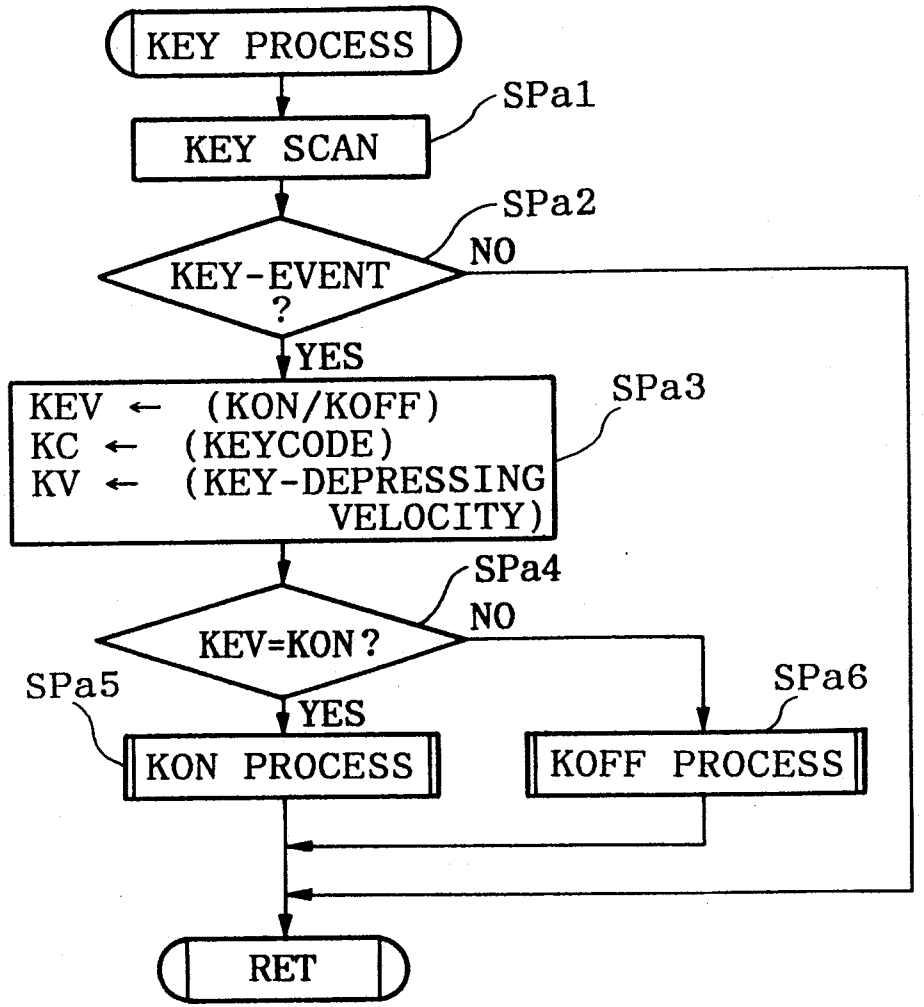
FIG.3(SUBROUTINE OF KEY PROCESS)

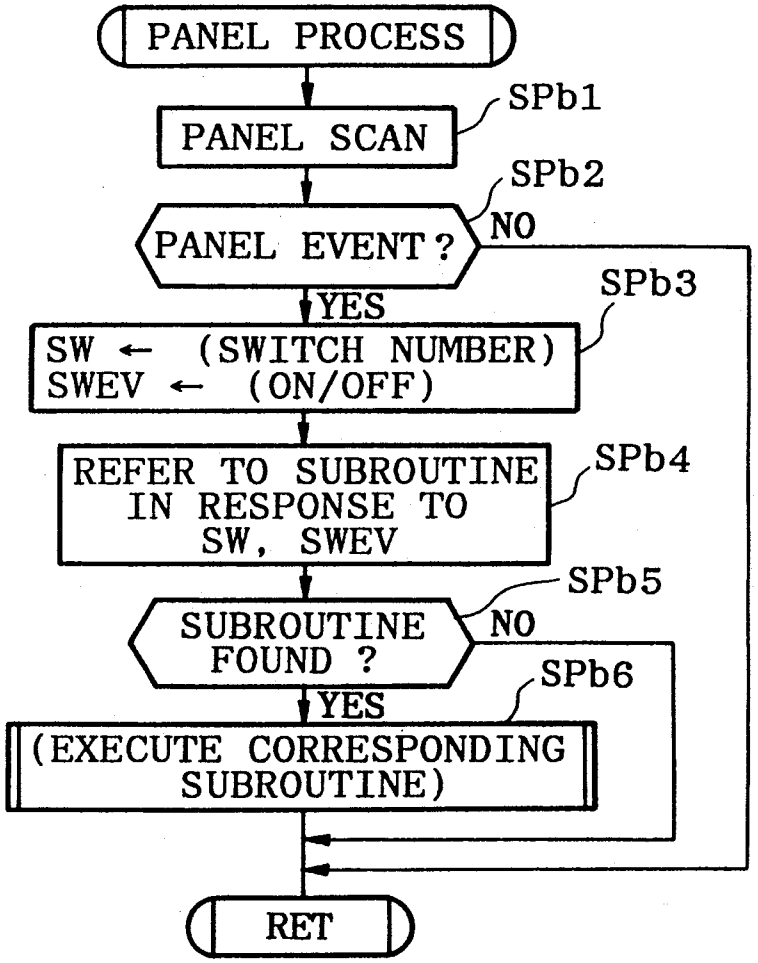
FIG.4 (SUBROUTINE OF PANEL PROCESS)
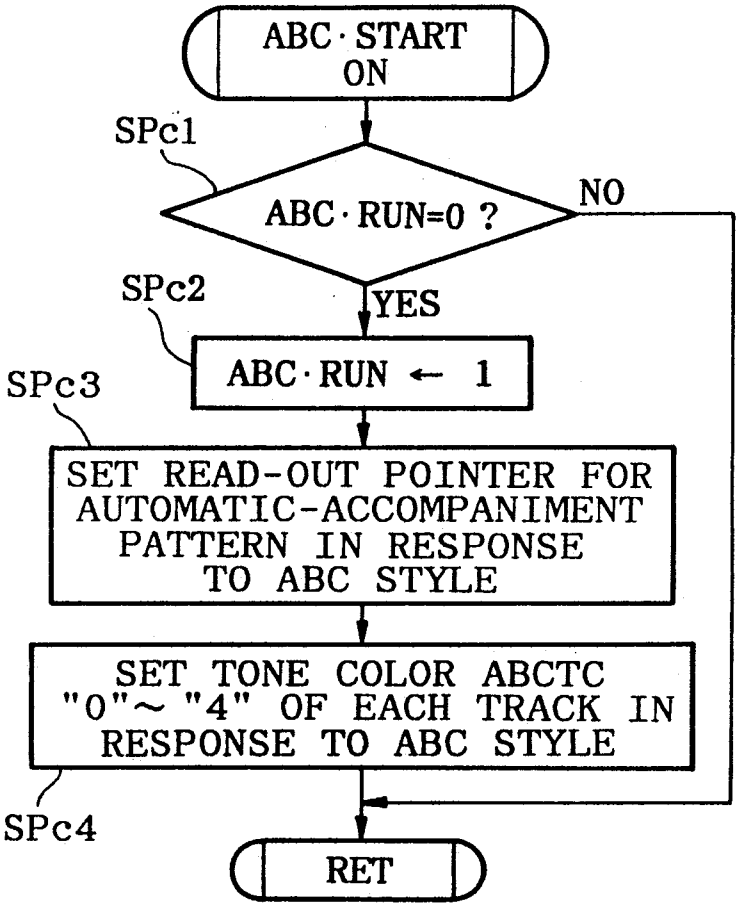
FIG.5 (SUBROUTINE OF AUTOMATIC-ACCOMPANIMENT START PROCESS)

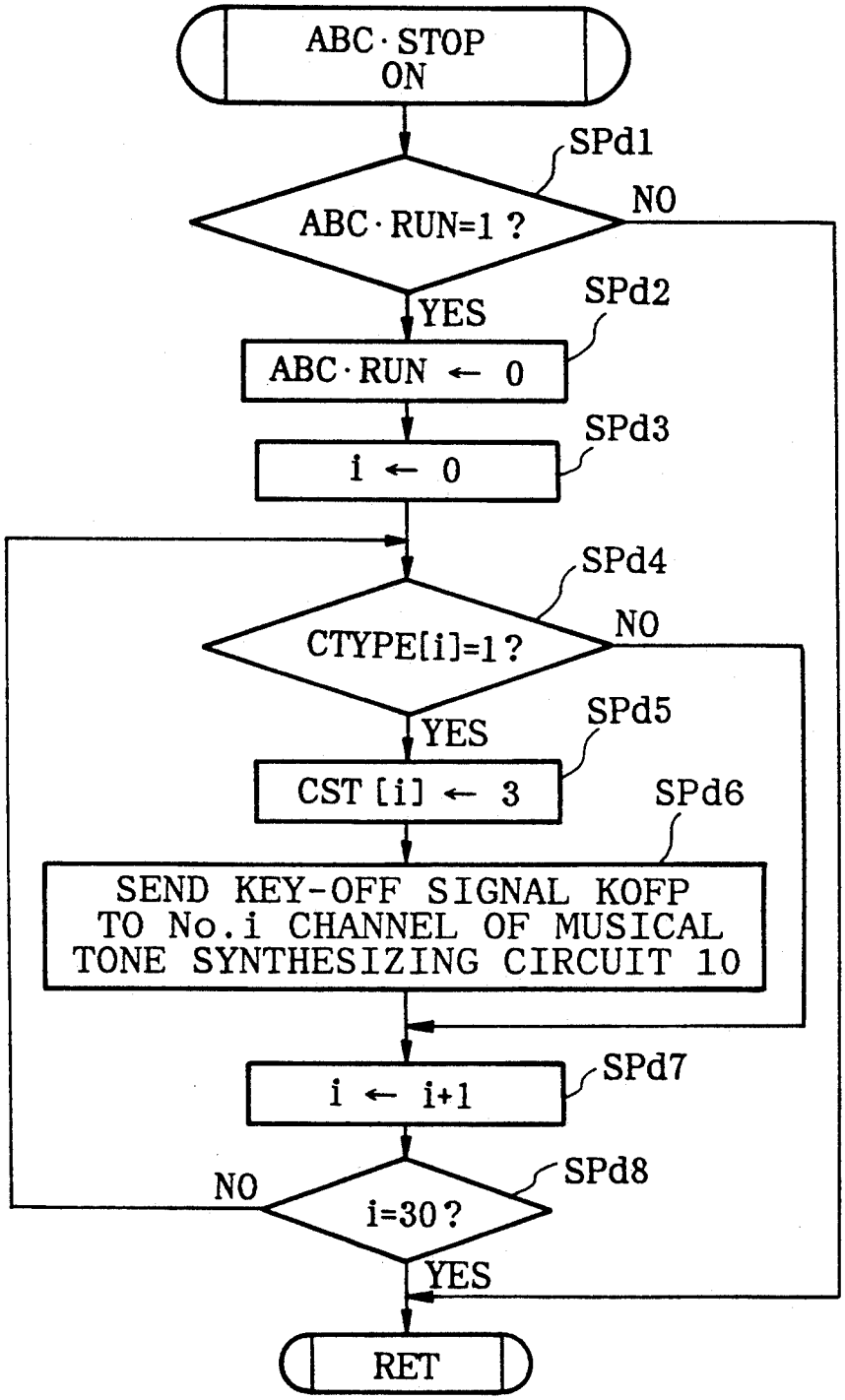
FIG.6 (SUBROUTINE OF AUTOMATIC-ACCOMPANIMENT END PROCESS)

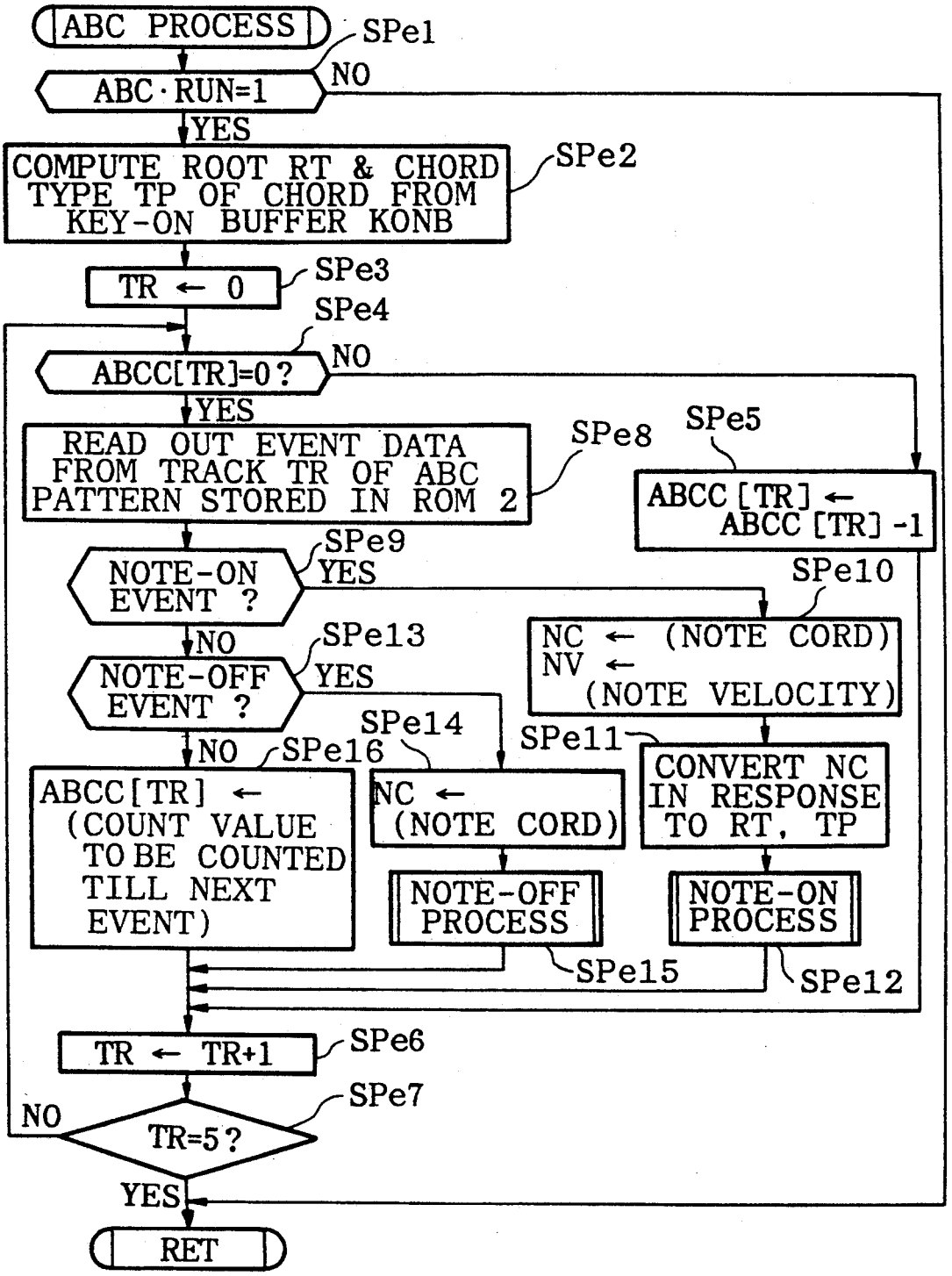
FIG.7 (SUBROUTINE OF AUTOMATIC-ACCOMPANIMENT PROCESS)

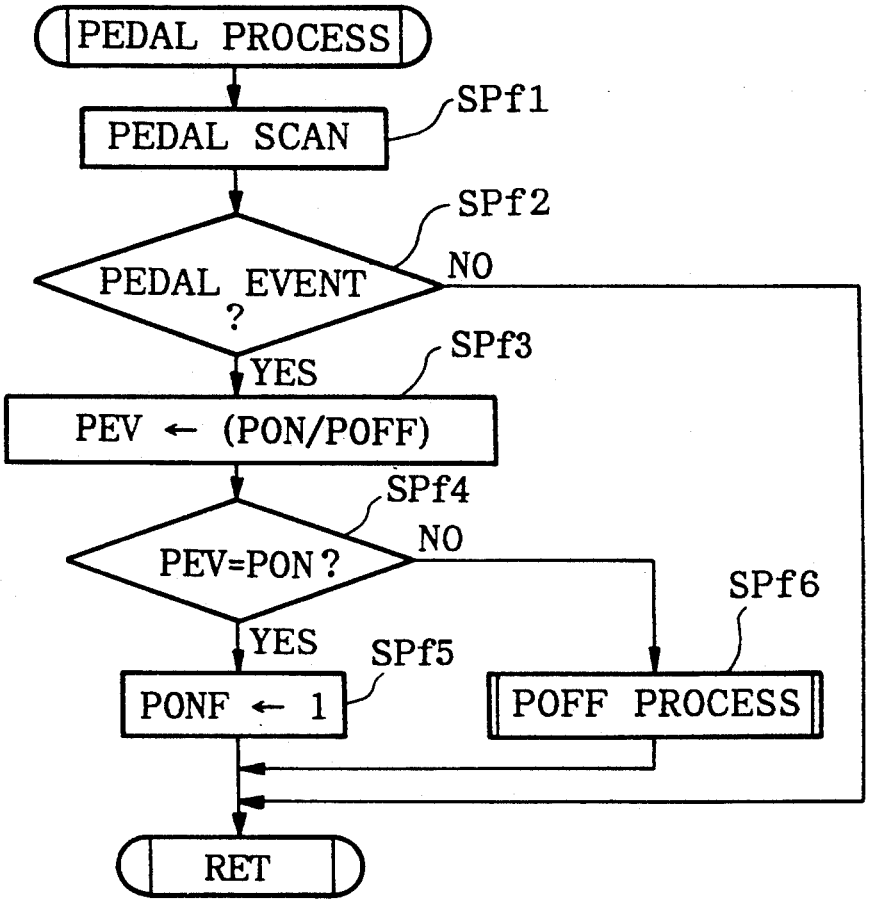
FIG.8 (SUBROUTINE OF FOOT-CONTROLLED MECHANISM PROCESS)

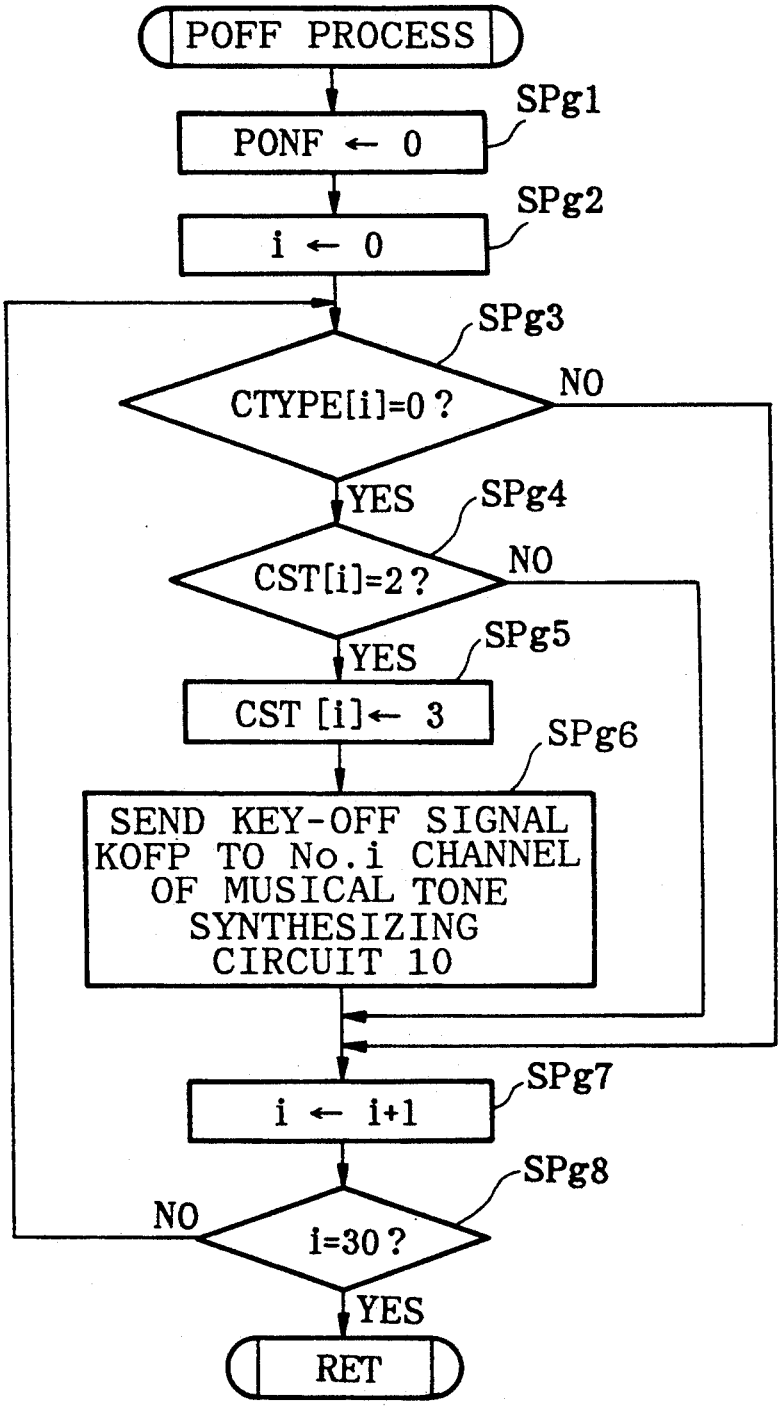
FIG.9 (SUBROUTINE OF PEDAL-OFF PROCESS)

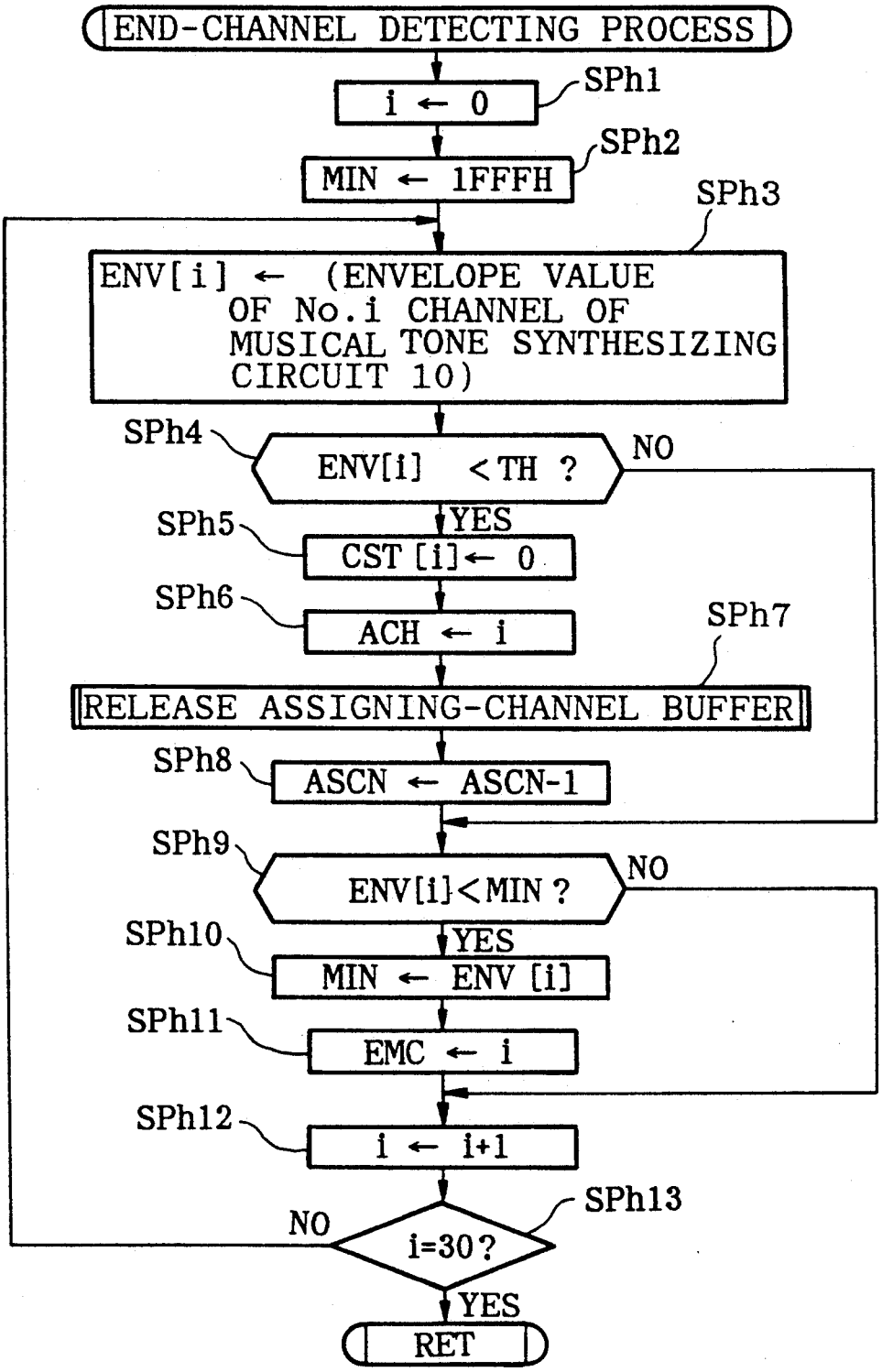
FIG.10 (SUBROUTINE OF END-CHANNEL DETECTING PROCESS)

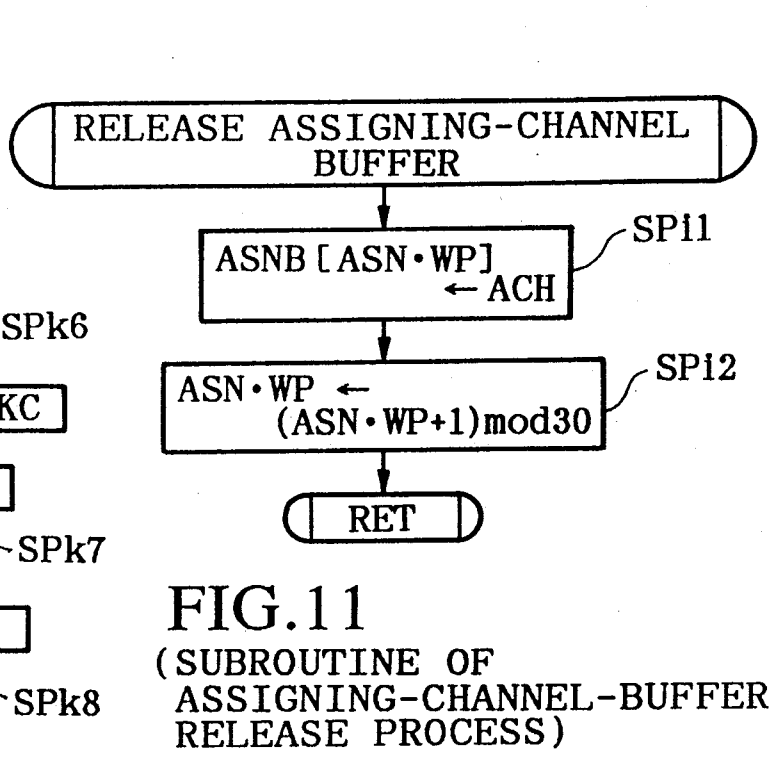
FIG. 11 (SUBROUTINE OF ASSIGNING-CHANNEL-BUFFER RELEASE PROCESS)
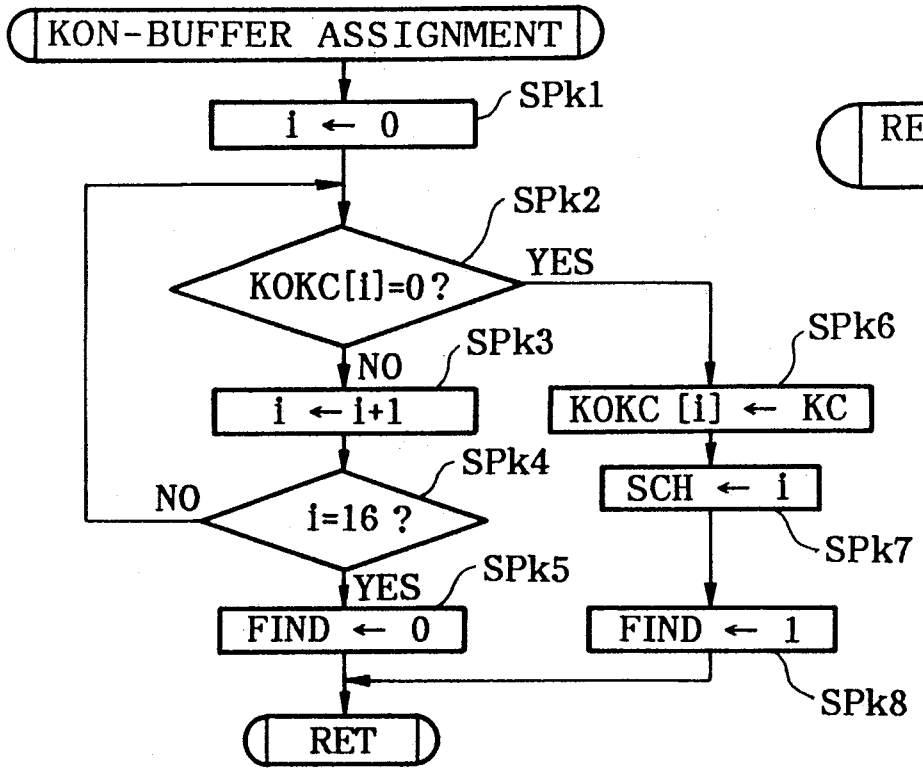
FIG. 13 (SUBROUTINE OF KEY-ON-BUFFER ASSIGNING PROCESS)

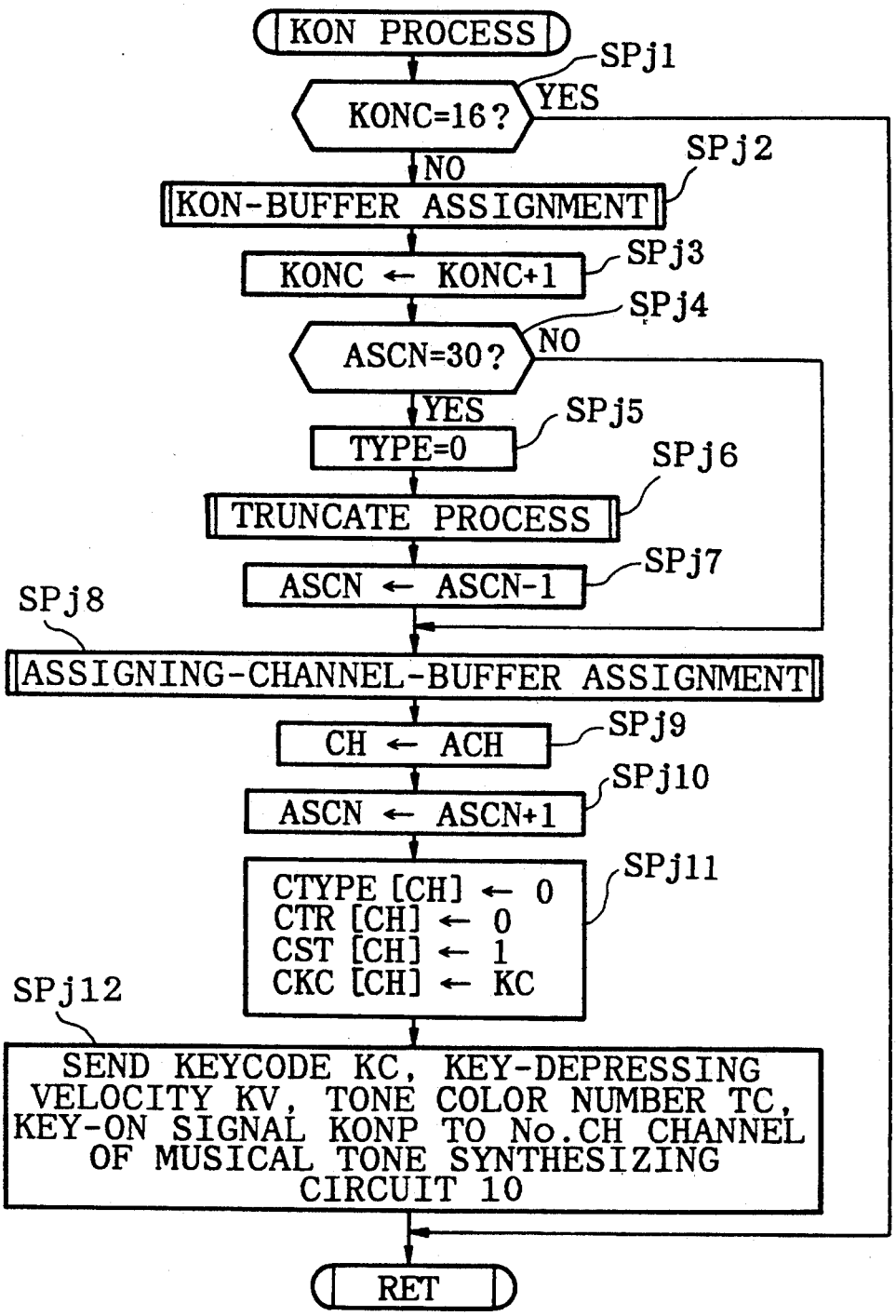
FIG.12 (SUBROUTINE OF KEY-ON PROCESS)

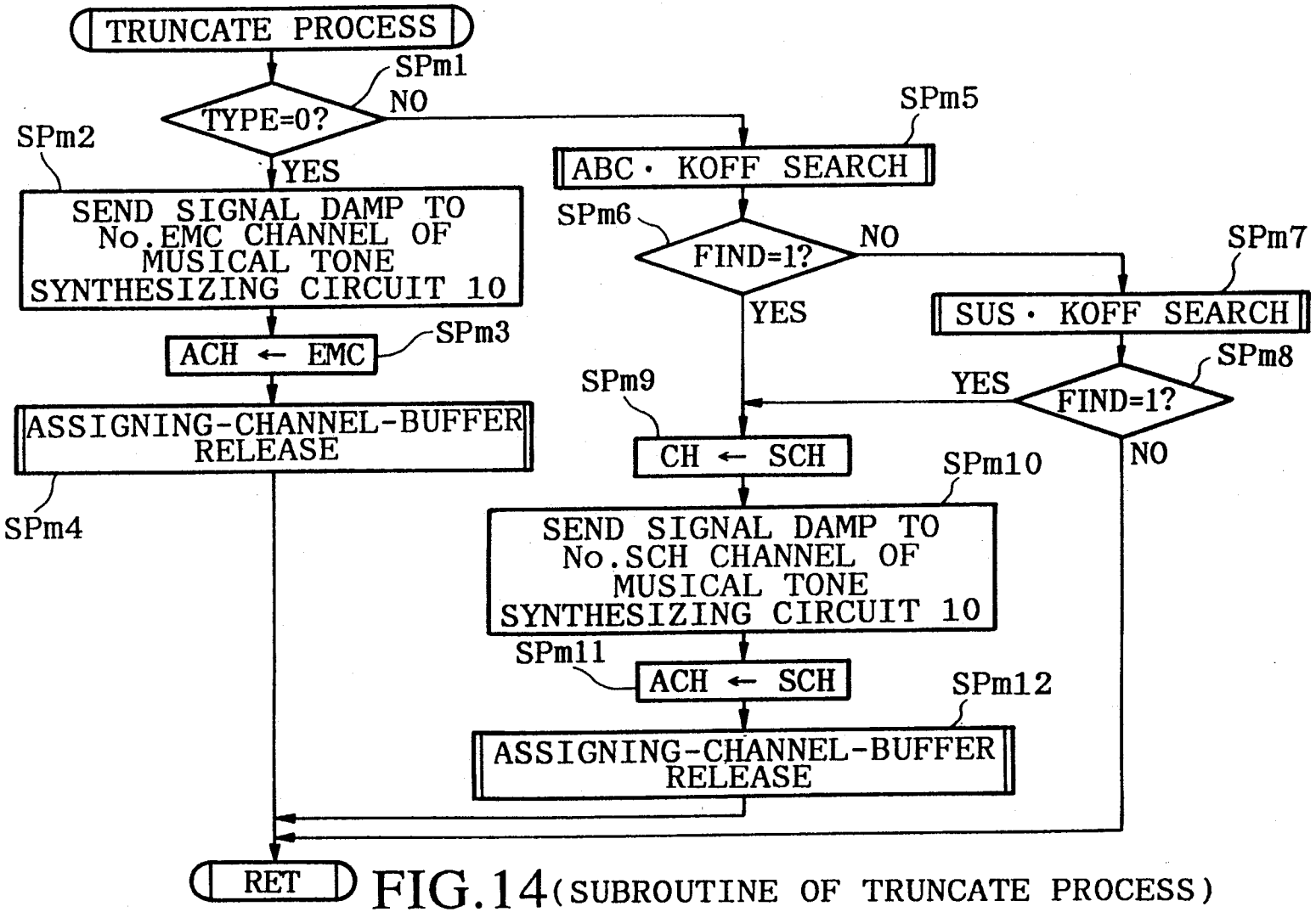
FIG. 14 (SUBROUTINE OF TRUNCATE PROCESS)

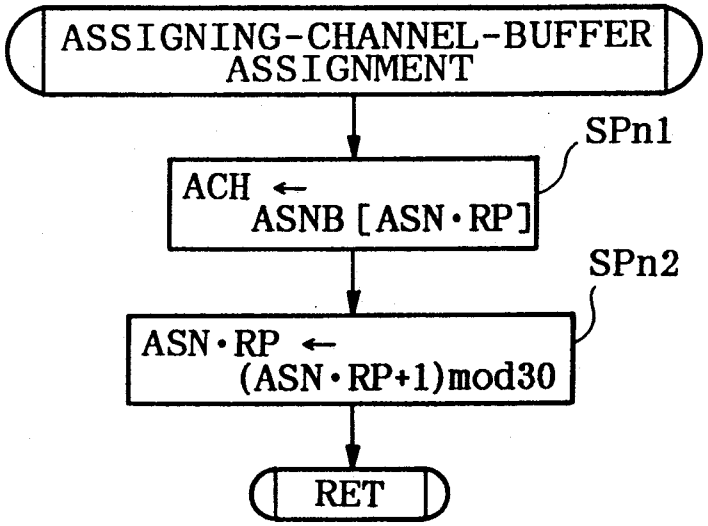
FIG.15 (SUBROUTINE OF ASSIGNING-CHANNEL-BUFFER ASSIGNING PROCESS)
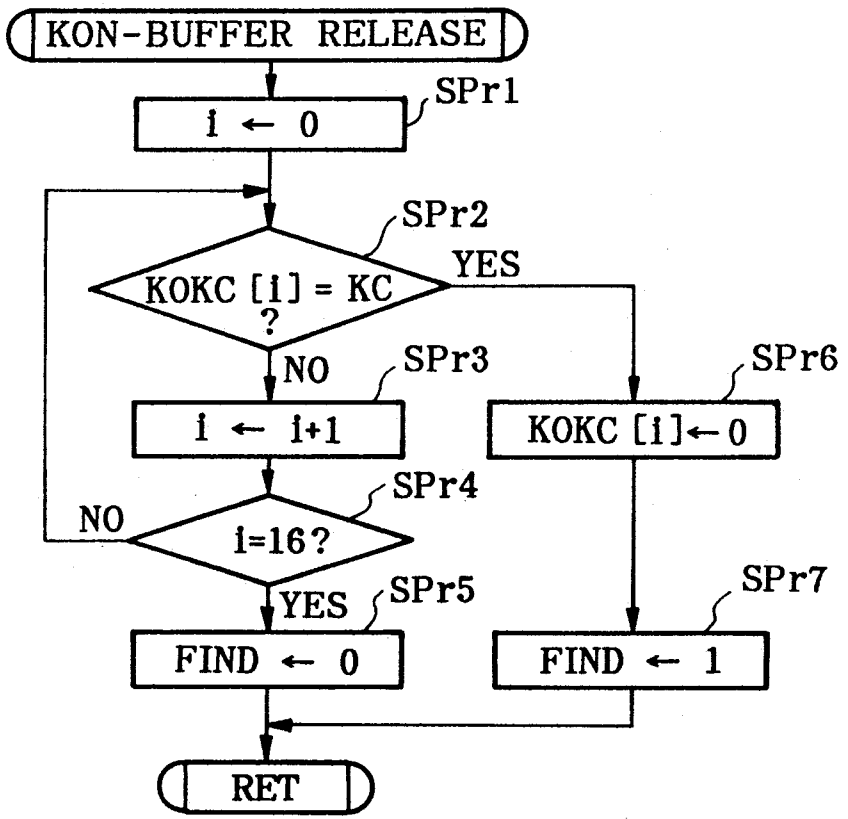
FIG.17 (SUBROUTINE OF KEY-ON-BUFFER RELEASING PROCESS)

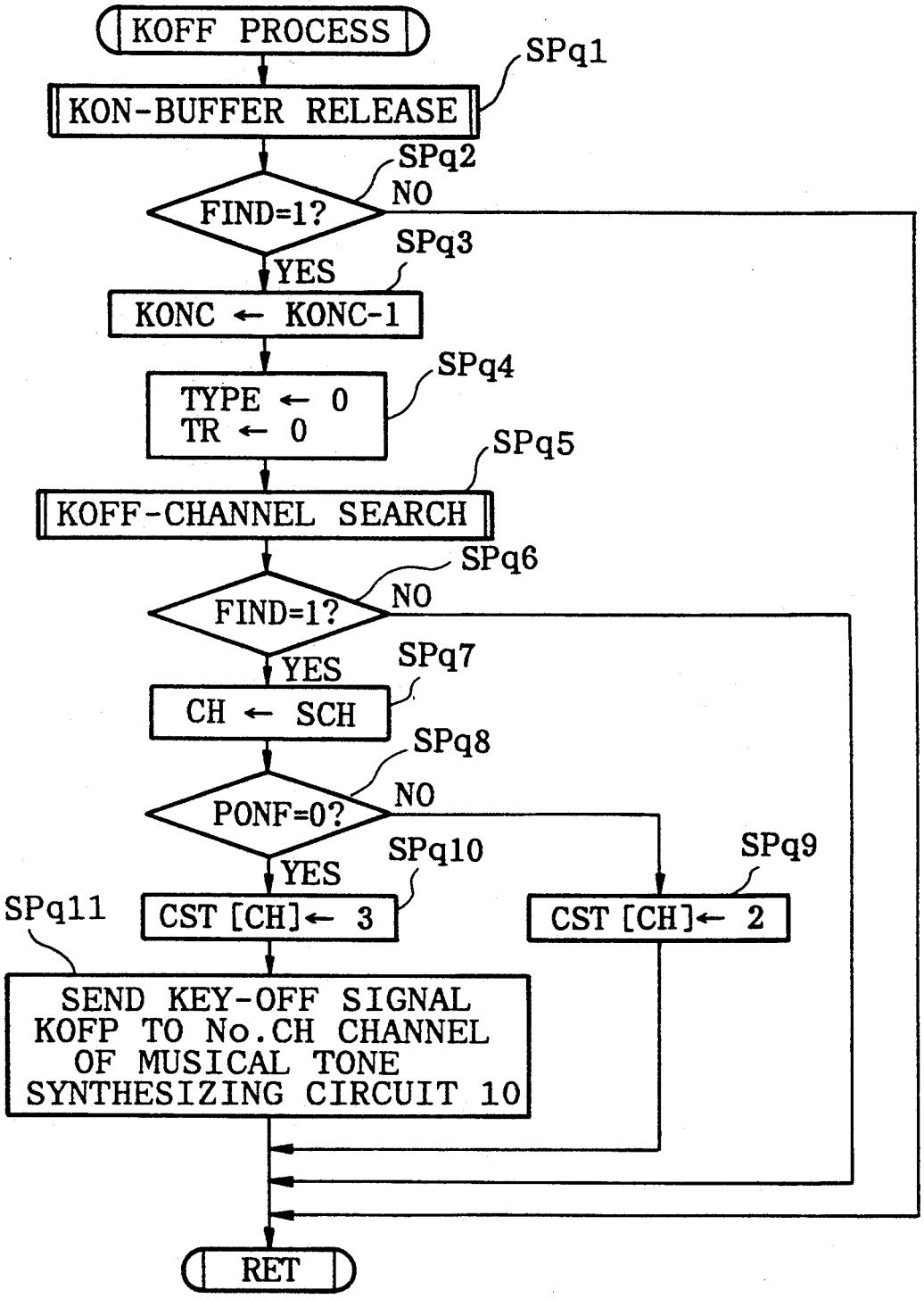
FIG.16 (SUBROUTINE OF KEY-OFF PROCESS)

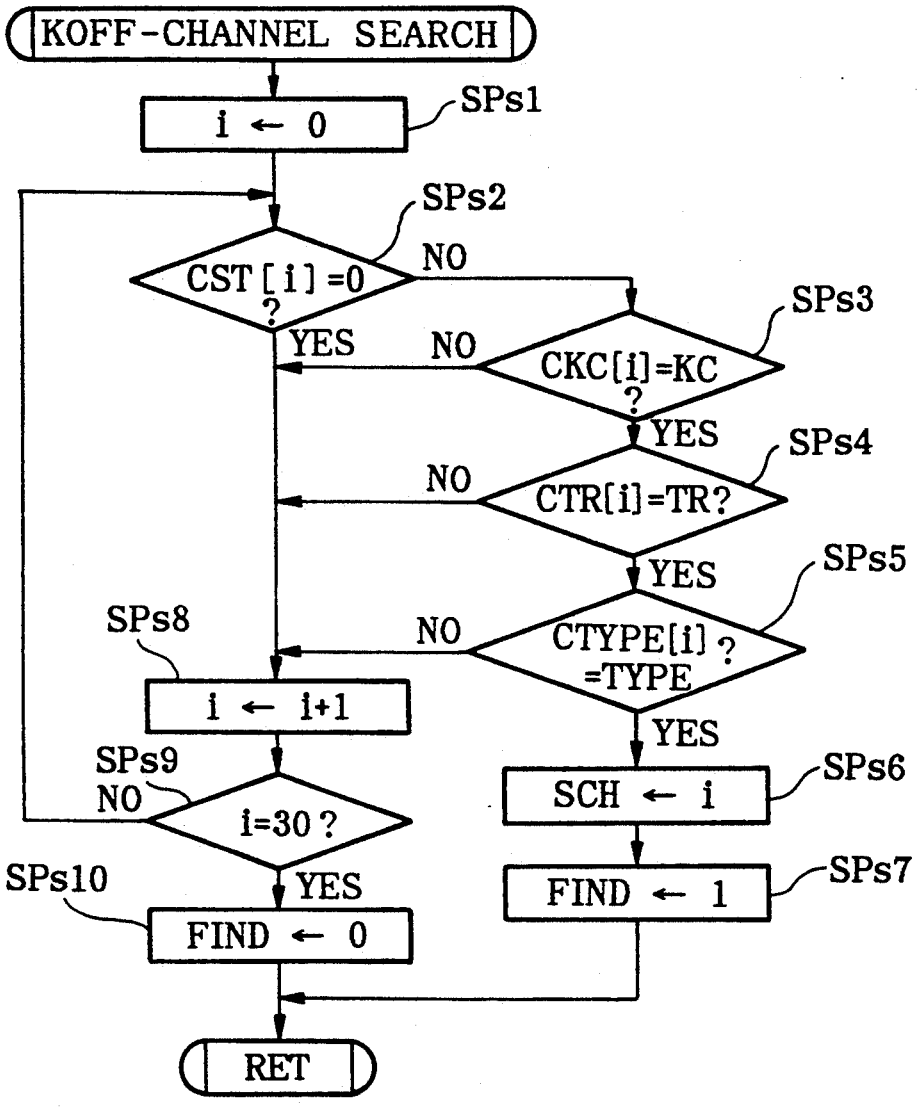
FIG.18 (SUBROUTINE OF KEY-OFF-CHANNEL SEARCHING PROCESS)

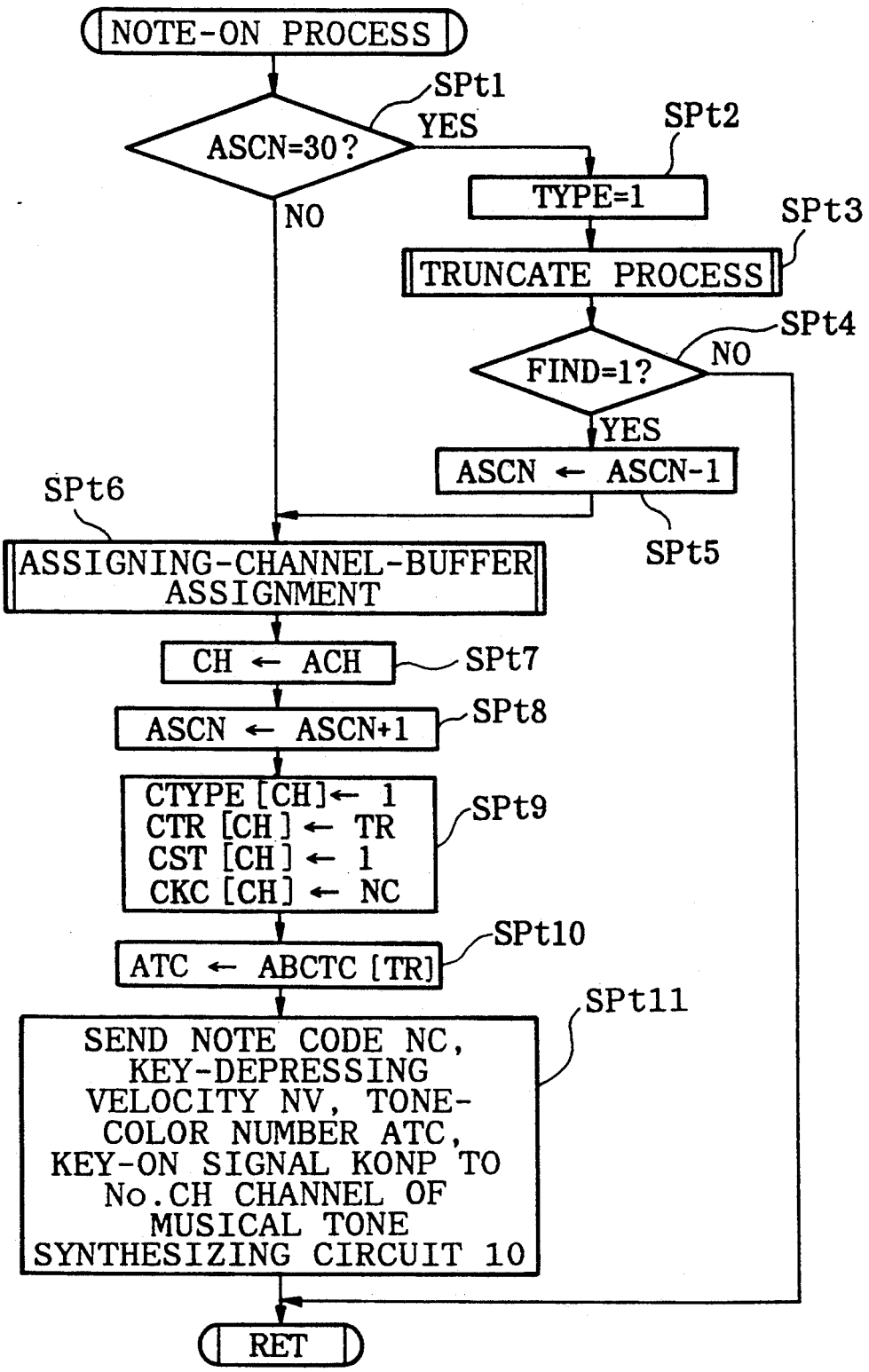
FIG.19(SUBROUTINE OF NOTE-ON PROCESS)

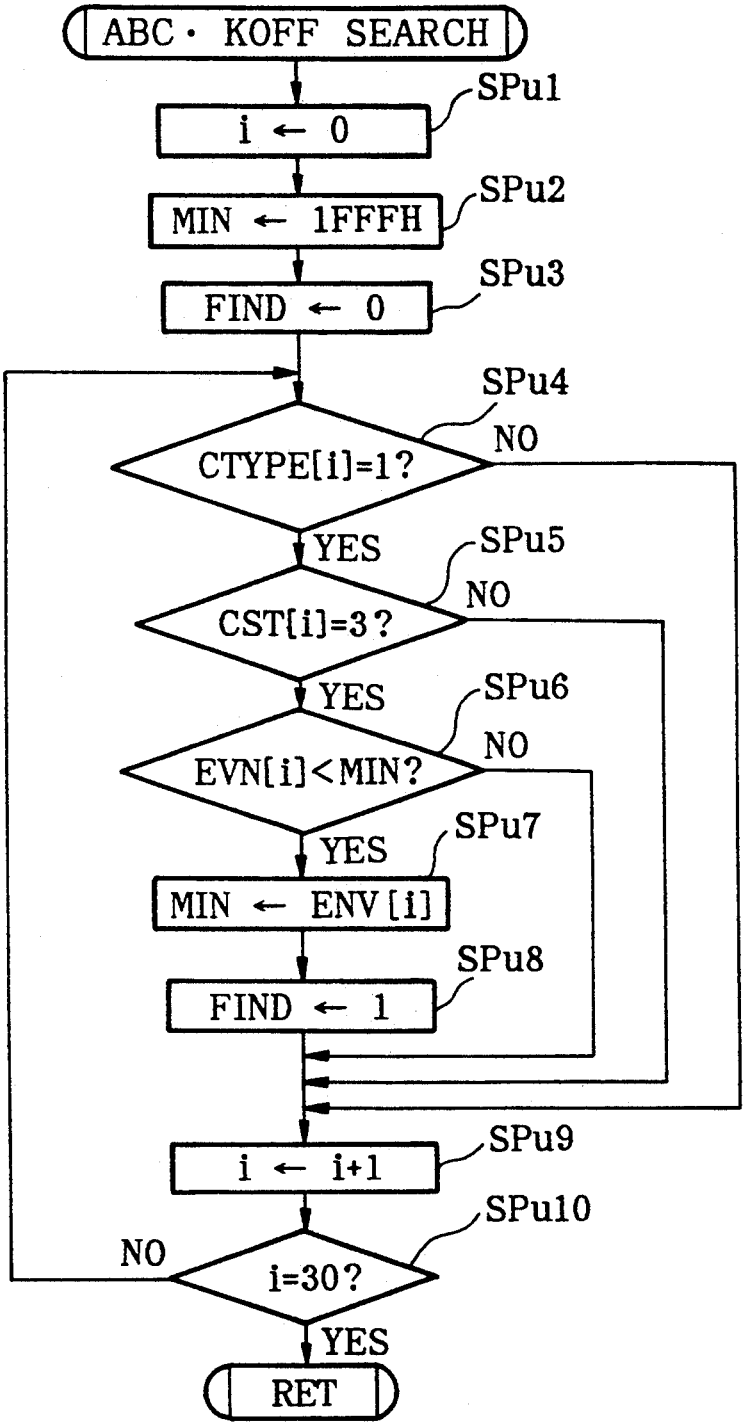
FIG.20 (SUBROUTINE OF AUTOMATIC-ACCOMPANIMENT-KEY-OFF SEARCHING PROCESS)

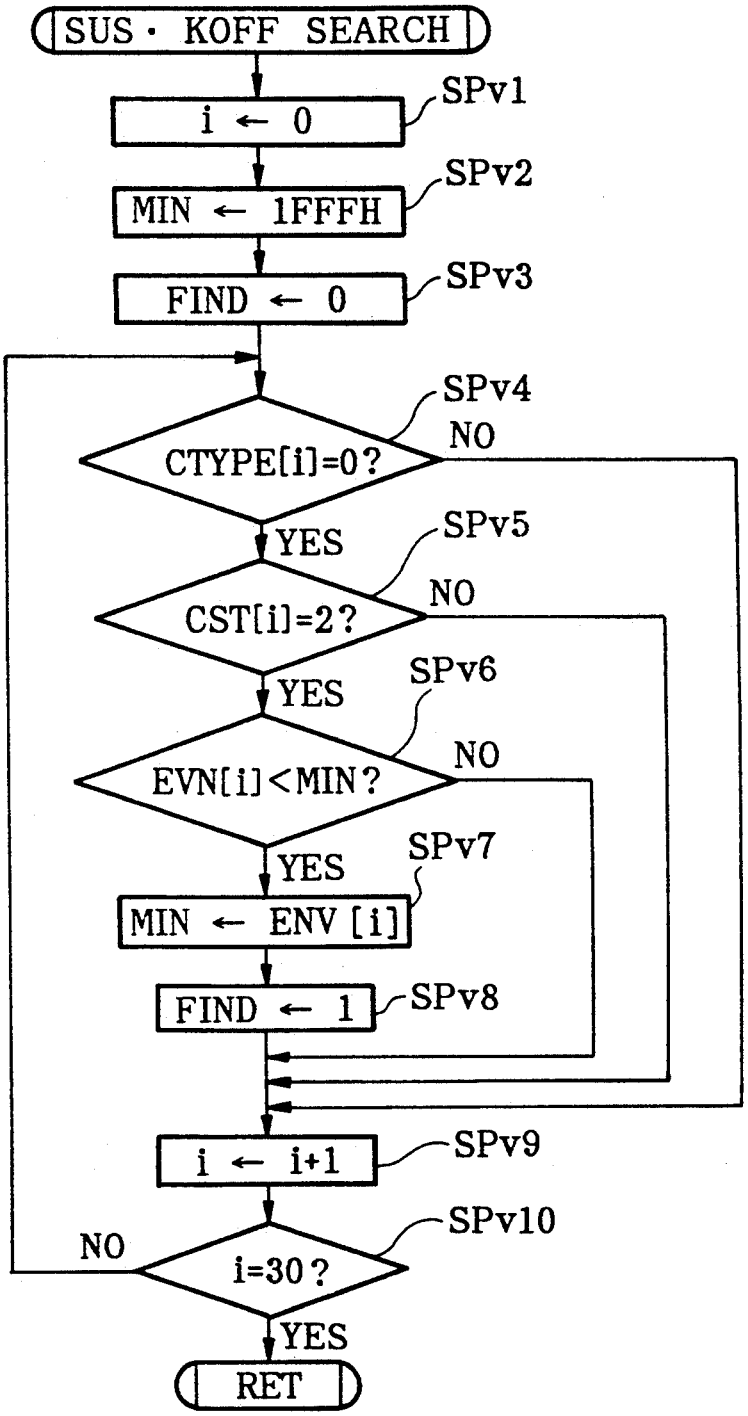
FIG.21 (SUBROUTINE OF SUSTAINING-KEY-OFF SEARCHING PROCESS)

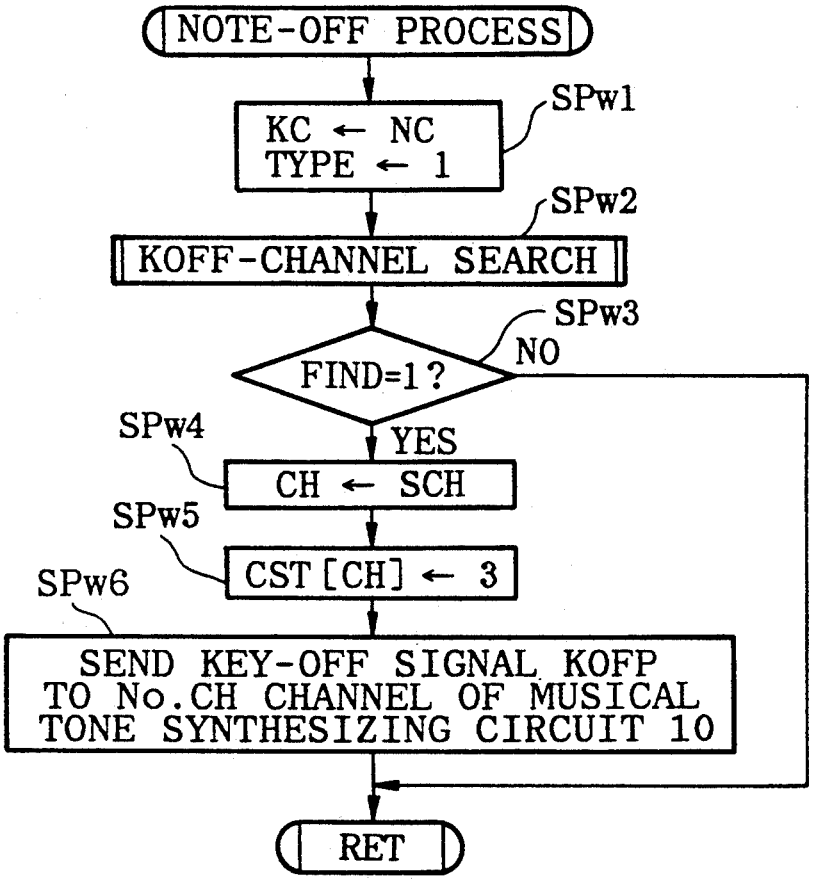
FIG.22 (SUBROUTINE OF NOTE-OFF PROCESS)

ELECTRONIC MUSICAL INSTRUMENT HAVING AUTOMATIC CHANNEL-ASSIGNING FUNCTION

BACKGROUND OF THE INVENTION

1. Field of the Invention

The present invention relates to an electronic musical instrument providing plural tone-generation channels by which both an automatic accompaniment and a manual performance can be simultaneously played.

2. Prior Art

Recently, several kinds of electronic musical instruments each having an automatic accompaniment function have been developed. This kind of electronic musical instrument can simultaneously generate plural sounds, and therefore provides plural tone-generation channels. Thus, automatic-accompaniment sounds and manual-performance sounds can be respectively assigned to the different tone-generation channels in accordance with several kinds of the channel-assignment methods.

In the conventional electronic musical instrument, there are provided two kinds of tone-generation channels exclusively assigned to the manual-performance sounds and automatic-accompaniment sounds respectively in advance. Herein, each sound is assigned to each of the exclusive-use channels. In this case, even if the channels exclusively used for the automatic-accompaniment sounds are not used at all, these channels cannot be used for the manual-performance sounds, which raises a drawback in that the channel-use efficiency must be relatively low.

In order to efficiently use the tone-generation channels, a development has been made to invent a brand-new channel assignment technique in which some of common-use channels are arbitrarily and dynamically assigned to the automatic-accompaniment sounds and manual-performance sounds. In such case, however, it is necessary to maintain a balance between the numbers of the tone-generation channels respectively assigned to the automatic-accompaniment sounds and manual-performance sounds. For this reason, the maximum number of the channels used for one of two kinds of sounds must be restricted, or the predetermined priority order must be given to one of two kinds of sounds.

When the number of the sounds to be generated becomes extremely large with respect to one of two kinds of sounds, even the above-mentioned channel-assignment technique cannot respond to it well. Thus, there is another drawback in that the channel assignment must be made un-naturally, which may prevent the music from being played smoothly.

SUMMARY OF THE INVENTION

It is accordingly a primary object of the present invention to provide an electronic musical instrument which can use the tone-generation channels efficiently.

It is another object of the present invention to provide an electronic musical instrument in which the channel-assignment operation can flexibly follow up with the change of the sounds to be generated automatically or manually so that music can be played smoothly and naturally.

In an aspect of the present invention, there is provided an electronic musical instrument of which circuitry comprises:

an automatic-accompaniment portion for designating an automatic-accompaniment sound when playing an automatic accompaniment on the basis of pre-stored automatic-accompaniment information;

a manual-performance portion for designating a manual-performance sound in accordance with a performance manually made by a performer;

a plurality of channels from which the automatic-accompaniment sounds and/or manual-performance sounds are generated;

a searching portion for searching an unoccupied channel within the channels which is not occupied with a tone generation;

an assignment portion for assigning a new musical tone to the unoccupied channel which is searched by the searching means, so that the new musical tone is generated from the unoccupied channel;

a first assignment portion, which is activated when a new manual-performance sound is designated under a full-channel condition where all of the channels are occupied with the tone generation, for detecting a channel of which envelope value is the smallest among the channels, so that the new manual-performance sound is assigned to the detected channel; and a second assignment portion, which is activated when a new automatic-accompaniment sound is designated under the full-channel condition, for detecting a channel which receives a key-off command and of which envelope value is the smallest among the channels occupied with the tone generation of the automatic-accompaniment sounds, so that the new automatic-accompaniment sound is assigned to the detected channel.

It is possible to further provide a third assignment portion which is activated when the second assignment portion fails to find out the channel satisfying the above-mentioned condition. This third assignment portion detects a channel which receives a key-off command but sustains to generate the manual-performance sound among the channels occupied with the tone generation of the manual-performance sounds, so that the new automatic-accompaniment sound is assigned to the detected channel.

As described above, a new musical tone is normally assigned to the unoccupied channel which is not occupied with the tone generation at the current timing. However, under the full-channel condition where all of the channels are occupied with the tone generation, the first assignment portion is activated to assign the new manual-performance sound to one of the channels of which envelope value is the smallest. If a new automatic-accompaniment sound is designated under the full-channel condition, the second assignment portion is activated to assign this new automatic-accompaniment sound to one of the channels occupied with the tone generation of the automatic-accompaniment sounds which receives a key-off command and of which envelope value is the smallest. If this second assignment portion fails to find out such channel, the third assignment portion is activated to assign the new automatic-accompaniment sound to one of the channels occupied with the tone generation of the manual-performance sounds which receives a key-off command but sustains to generate the manual-performance sound. If both of the second and third assignment portions fail to determine the channel satisfying the above-mentioned conditions, a tone-generation request for the new automatic-accompaniment sound is neglected. Incidentally, the above-mentioned automatic-accompaniment sound represents one example of the automatic-performance sound.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 1 is a block diagram showing an overall configuration of an electronic musical instrument according to an embodiment of the present invention;

FIG. 2 is a flowchart showing a main routine representing an overall operation of the embodiment;

FIG. 3 is a flowchart showing a subroutine of a key process;

FIG. 4 is a flowchart showing a subroutine of a panel process;

FIG. 5 is a flowchart showing a subroutine of an automatic-accompaniment start process;

FIG. 6 is a flowchart showing a subroutine of an automatic-accompaniment end process;

FIG. 7 is a flowchart showing a subroutine of an automatic-accompaniment process;

FIG. 8 is a flowchart showing a subroutine of a foot-controlled mechanism process;

FIG. 9 is a flowchart showing a subroutine of a pedal-off process;

FIG. 10 is a flowchart showing a subroutine of an end-channel detecting process;

FIG. 11 is a flowchart showing a subroutine of an assigning-channel-buffer releasing process;

FIG. 12 is a flowchart showing a subroutine of a key-on process;

FIG. 13 is a flowchart showing a subroutine of a key-on-buffer assigning process;

FIG. 14 is a flowchart showing a subroutine of a truncate process;

FIG. 15 is a flowchart showing a subroutine of an assigning-channel-buffer assigning process;

FIG. 16 is a flowchart showing a subroutine of a key-off process;

FIG. 17 is a flowchart showing a subroutine of a key-on-buffer releasing process;

FIG. 18 is a flowchart showing a subroutine of a key-off-channel searching process;

FIG. 19 is a flowchart showing a subroutine of a note-on process;

FIG. 20 is a flowchart showing a subroutine of an automatic-accompaniment-key-off searching process;

FIG. 21 is a flowchart showing a subroutine of a sustaining-key-off searching process; and FIG. 22 is a flowchart showing a subroutine of a note-off process.

DESCRIPTION OF THE PREFERRED EMBODIMENT

Next, description will be given with respect to an electronic musical instrument according to an embodiment of the present invention by referring to the drawings.

[A] Configuration of Embodiment

FIG. 1 is a block diagram showing the overall configuration of the electronic musical instrument according to an embodiment of the present invention. In FIG. 1, 1 designates a central processing unit (CPU) which controls operations at several portions of the circuitry on the basis of programs pre-stored in a read-only memory (ROM) 2. This ROM 2 memorizes automatic accompaniment patterns which are used for playing the automatic accompaniment. Several kinds of automatic accompaniment patterns are provided for selected ones of the predetermined rhythms. Each of them is constructed by the data corresponding to plural tracks, wherein each of the tracks is constructed by several performance patterns which are used for playing the accompaniment by use of the sounds of several kinds of musical instruments. In addition, 3 designates a random-access memory (RAM) which temporarily stores several kinds of data.

Meanwhile, 4 designates a keyboard of which a performed state is detected by a keyboard interface 5. In short, this keyboard interface 5 detects a keycode representing the pitch of the depressed key and a key velocity representing the depressing intensity (or velocity) of the key. The signals representing these parameters are supplied to the CPU 1 wherein they are properly processed. Further, 6 designates an operation panel providing several kinds of switches and controls by which the tone color, tempo, performance mode, etc. are set. The output signal of each switch in this operation panel 6 is supplied to the CPU 1 via a panel interface 7.

Next, 8 designates foot-controlled mechanisms containing the sustaining pedal, soft pedal (or volume pedal), and other foot-controlled elements. The output signal of each foot-controlled element is supplied to the CPU 1 via an interface 9. Under control of the CPU 1, a musical tone synthesizing circuit 10 synthesizes musical tone signals, wherein this circuit 10 provides thirty tone-generation channels (hereinafter, simply referred to as "channels"). Thus, the present electronic musical instrument is designed to simultaneously generate thirty sounds. The musical tone signal created by the musical tone synthesizing circuit 10 is supplied to a sound system 11 wherein it is amplified and then the corresponding musical tone is sounded from a speaker 12.

[B] Operation of Embodiment

Next, description will be given with respect to the operations of the present embodiment by referring to the flowcharts shown in FIGS. 2 to 22.

(1) Overall Operation

First, the overall operation of the present embodiment will be described by referring to FIG. 2 which shows a main routine of the present embodiment.

In a first step SP1 shown in FIG. 2, initial values are set to or a reset operation is made to several kinds of registers. In a next step SP2, a key process is carried out when the key is depressed or the depressed key is released. When completing the key process, the processing proceeds to step SP3 wherein an automatic-accompaniment process (hereinafter, simply referred to as "ABC process") is carried out. In this automatic-accompaniment process, the chords or bass sounds are automatically produced in addition to the manual-performance sounds created by the performer. After executing this ABC process, the processing proceeds to step SP4 wherein a panel process is carried out. In the panel process, several kinds of the predetermined operations are made in response to the operated manual-operable members provided on the operation panel 6. For example, when the performer depresses the switch designating the start or end timing of the automatic accompaniment, the CPU 1 executes the process by which the automatic accompaniment mode is turned on or off. After executing the panel process, the processing proceeds to step SP5 wherein a foot-controlled mechanism process is carried out. In this process, when a pedal (e.g., sustaining pedal) is depressed, the stored contents of the predetermined registers are rewritten in response to the operated pedal. After executing this foot-controlled mechanism process, the processing proceeds to step SP6 wherein an end-channel detecting process is carried out so that the CPU 1 detects the channel of which a sounding operation is ended within thirty channels.

The above-mentioned processes of steps SP2 through SP6 are circulatingly executed. Next, a detailed description will be given with respect to the contents of each process.

① Key Process

The subroutine of the key process is constructed by steps as shown in FIG. 3. At first, the keyboard interface 5 performs a key-scanning operation on each of the keys provided in the keyboard 4 in step SPa1, thus judging whether or not a key event has occurred on each key in step SPa2. Herein, the key event indicates a change of the key state. In short, there are two kinds of key events, wherein one of them corresponds to the event (i.e., key-on) in which the key is newly depressed on, while the other corresponds to the event (i.e., key-off) in which the depressed key is released. If the judgement result of step SPa2 is "NO", the processing directly returns to the foregoing main routine shown in FIG. 2 without substantially executing any processes of this subroutine. On the other hand, if the judgement result of step SPa2 is "YES", the processing proceeds to step SPa3 wherein key-on or key-off data is written in a key-event register KEV. In addition, a keycode is written in a keycode register KC, while a key-depressing velocity is written in a key-velocity register KV. In a next step SPa4, it is judged whether or not the key-on data is written in the key-event register KEV. If the judgement result of step SPa4 is "YES", the processing proceeds to step SPa5 wherein a key-on process is executed. If the judgement result is "NO", the processing branches to step SPa6 wherein a key-off process is executed. After executing the process of step SPa5 or SPa6, the processing returns back to the main routine. Incidentally, the detailed contents of the key-on process and key-off process will be described later.

② Panel Process

The subroutine of the panel process is constructed by steps shown in FIG. 4. In a first step SPb1 of this subroutine, a panel-scanning operation is carried out so as to detect the operating state of each of the switches provided on the operation panel 6. In a next step SPb2, it is judged whether or not a panel event, representing a change of the operating state of each switch, has occurred. If the judgement result of step SPb2 is "NO", the processing directly returns to the main routine without substantially executing any processes of this subroutine. If the judgement result is "YES", the processing proceeds to step SPb3 wherein the number of the operated switch is written in a register SW. In addition, the kind of the panel event, i.e., switch-on or switch-off event, is written in a register SWEV. In a next step SPb4, the CPU 1 searches the subroutine corresponding to the contents of the registers SW, SWEV by referring to the predetermined table. In a step SPb5, it is judged whether or not the corresponding subroutine is found. If no subroutine is found, the processing directly returns to the main routine. This is because some panel events do not require such subroutine to be executed.

In contrast, when the corresponding subroutine is found, the processing proceeds to step SPb6 wherein the processes of such subroutine are carried out. As examples of such subroutine, description will be given with respect to subroutines as shown in FIGS. 5, 6 which are activated when depressing the automatic-accompaniment start switch and stop switch respectively.

In FIG. 5, it is judged whether or not a flag ABC·RUN is set at "0" in step SPc1. This flag ABC·RUN is used to discriminate the automatic-accompaniment mode from the other modes. In the case of the automatic-accompaniment mode, "1" is set to this flag. When the judgement result of this step SPc1 is "NO", representing that the automatic-accompaniment mode has been already set, the processing directly returns to the main routine without substantially executing any processes in this subroutine. On the other hand, if the judgement result of step SPc1 is "YES", the flag ABC·RUN is set at "1" in step SPc2. In a next step SPc3, a read-out pointer for the automatic-accompaniment pattern is set at the address representing the style of the automatic accompaniment which is selected by operating the switch provided on the operation panel 6. Since the automatic-accompaniment pattern is stored in the ROM 2 as described before, the head address of the memory area wherein each pattern is stored is set to the read-out pointer in step SPc3. Then, the processing proceeds to step SPc4 wherein the tone color of each track of the automatic-accompaniment pattern is set in response to the selected style. In this case, each of registers ABCTC[0] through ABCTC[4] stores the tone color of each track. Thus, the codes representing the tone colors are written into these registers. After completing the process of step SPc4, the processing returns to the main routine.

Meanwhile, when the automatic-accompaniment stop switch is depressed, the subroutine as shown in FIG. 6 is activated. In a first step SPd1 of this subroutine, it is judged whether or not the flag ABC·RUN is at "1". If the judgement result of step SPd1 is "NO", representing that the automatic-accompaniment mode has been released, the processing directly returns to the main routine without substantially executing any processes of this subroutine. If the judgement result of step SPd1 is "YES", the CPU 1 clears the flag ABC·RUN in step SPd2 and then resets a register i in step SPd3. In a next step SPd4, it is judged whether or not a value of a register CTYPE[i] is at "1". In response to the number of the channels, there are provided thirty registers CTYPE[i] (where i is ranging from "0" to "29"). Herein, the manual performance is indicated when the value of this register is at "0", while the automatic accompaniment is indicated when it is at "1". If the judgement result of step SPd4 is "NO", the processing branches to step SPd7 wherein the value of the register i is incremented by "1". Then, the processing returns to the foregoing step SPd4 again via step SPd8. On the other hand, if the judgement result of step SPd4 is "YES", a value "3" is written in a register CST[i] in step SPd5. The contents of the register CST[i] designates the state of the channel to be assigned, wherein the value "3" designates a key-off state. In other words, although a certain channel is assigned to the tone generation of the automatic accompaniment, the CPU 1 sends a key-off command to such channel. Then, the processing proceeds to step SPd6 wherein a key-off signal KOFP is sent to its corresponding channel within the musical tone synthesizing circuit 10.

Thereafter, the processing returns to the step SPd4 again via step SPd8. Thus, the above-mentioned processes of steps SPd4 through SPd7 are repeatedly performed until the judgement result of step SPd8 turns to "YES", i.e., until the value of the register i reaches "30". Therefore, the subroutine of the key-off process is performed on all of the channels (of which channel number ranges from "0" to "29"), so that the key-off signals KOFP are outputted to the channels, each of which has been assigned with the tone generation of the automatic accompaniment. When receiving such key-off signal, each of the channels suspends the tone generation, and consequently, the automatic accompaniment is stopped.

③ Automatic-Accompaniment Process

The subroutine of the automatic-accompaniment process is constructed by the steps of FIG. 7. In a first step SPe1 of this subroutine, it is judged whether or not the flag ABC·RUN is at "1". If the judgement result of step SPe1 is "NO", representing that the automatic-accompaniment mode is not designated, the processing directly returns to the main routine. On the other hand, if the judgement result is "YES", a root RT and a chord type TP of the chord are detected on the basis of the contents of a key-on buffer KONB in step SPe2. This key-on buffer KONB is constructed by a register which stores the keycode of the key depressed by the performer, and the stored keycode is used to detect the chord type TP and root RT. In a step SPe3, "0" is set to a register TR which is used to designate the track number of the automatic accompaniment. In a next step SPe4, it is judged whether or not "0" is set at a counter ABCC[TR]. This counter ABCC[TR] counts down the value thereof between the current event and next event with respect to each of the tracks of the automatic accompaniment. When the judgement result of step SPe4 is "NO", the processing branches to step SPe5 wherein the value of the counter ABCC[TR] is decremented by "1". Then, the processing proceeds to step SPe6 wherein the value of the register TR is incremented by "1". Thereafter, the processing returns back to the foregoing step SPe4 via step SPe7.

In contrast, when the judgement result of step SPe4 is "YES", the processing proceeds to step SPe8 wherein the event data is read from the track (of which the track number is designated by the register TR) of the automatic-accompaniment pattern. In the case where the value of the counter ABCC[TR] reaches "0", the CPU 1 starts to read out the data from the ROM 2. In other cases, the value of the counter ABCC[TR] is decremented by "1". The above-mentioned processes are required because each note included in the automatic-accompaniment pattern is memorized by a note-on event (representing the start timing of the tone generation) and a note-off event (representing the suspension of the tone generation), while the data representing the time between two events is memorized between two event data. In addition, such time data is incorporated into the contents of the counter ABCC[TR] (in step SPe16 which will be described later), so that the next event data is read out when the count value reaches "0".

When the event data read in the foregoing step SPe8 designates the note-on event, the processing proceeds to step SPe10 via step SPe9, wherein a note code designating the pitch of the musical tone is written in a register NC, while a note velocity representing the sounding intensity of the musical tone is written in a register NV. In a next step SPe11, the note code stored in the register NC is subjected to the data conversion on the basis of the chord type TP and root RT. This process of step SPe11 is required because the automatic-accompaniment pattern stored in the ROM 2 is created on the basis of the fundamental chord type and fundamental root which are determined in advance. Thus, by executing the process of step SPe11, such automatic-accompaniment pattern is converted to be matched with the chord type and root of the chord which is actually performed. After executing this process, the processing proceeds to step SPe12 wherein a note-on process is executed. Thereafter, the processing returns to the foregoing step SPe4 via steps SPe6, SPe7.

On the other hand, when the note-off event is read out in step SPe8, the processing proceeds to step SPe14 via steps SPe9, SPe13, wherein its note code is written in the register NC so that a note-off process will be executed in step SPe15. When completing the note-off process, the processing returns back to the foregoing step SPe4 via steps SPe6, SPe7.

In the case where the data read in step SPe8 does not designate the note-on event nor the note-off event, such data must be the data representing the interval between the events. In this case, the processing passes through steps SPe9, SPe13 and then proceeds to step SPe16 wherein the read data is written into the counter ABCC[TR]. Thereafter, the processing returns to step SPe4 via steps SPe6, SPe7.

The above-mentioned processes of steps SPe4 through SPe16 are carried out with respect to each value of the register TR (which ranges from "0" to "4"), i.e., each of the track numbers "0" through "4" of the automatic-accompaniment pattern. When completely performing these processes with respect to all of the track numbers, the judgement result of step SPe7 turns to "YES", so that the processing returns to the main routine.

④ Foot-Controlled Mechanism Process

The subroutine of the foot-controlled mechanism process is constructed by steps shown in FIG. 8. In a first step SPf1 of FIG. 8, the scanning operation is performed on the foot-controlled mechanisms so as to detect their operating states. In order to simplify the description concerning this process, description will be given with respect to the sustaining pedal only. In a step SPf2, it is judged whether or not a pedal event has occurred. If the judgement result of step SPf2 is "NO" which represents that no process is required in this subroutine, the processing returns back to the main routine. On the other hand, if the judgement result of step SPf2 is "YES", data PON or POFF representing the on-event or off-event of the sustaining pedal is written into a register PEV in step SPf3. In a next step SPf4, it is judged whether or not the data written in the register PEV is the data PON. If the judgement result of step SPf4 is "YES", "1" is set to a pedal-on flag PONF in step SPf5, and then the processing returns back to the main routine. On the other hand, if the judgement result of step SPf4 is "NO", the processing branches to step SPf6 wherein a pedal-off process is made.

The subroutine of the pedal-off process is constructed by steps shown in FIG. 9. In a first step SPg1, the pedal-on flag PONF is cleared to the zero level. In a next step SPg2, the register i is cleared so that its value is reset to "0". In a step SPf3, it is judged whether or not the value of the register CTYPE[i] is equal to "0". If the value "1" indicating the automatic-accompaniment mode is set at the register CTYPE[i], the processing directly branches to step SPg7 wherein the value of the register i is incremented by "1". Then, the processing returns to step SPg3 again via step SPg8. If the judgement result of step SPg3 is "YES", the processing proceeds to step SPg4 wherein it is judged whether or not the value of the register CST[i] is set at "2". This value "2" represents an event in which the key-off command is sent to the No. i channel. However, this channel is in the sustaining duration so that the sounding operation is sustained for a while, regardless of the key-off command. If the judgement result of step SPg4 is "NO", the processing returns to step SPg3 again via steps SPg7, SPg8. On the other hand, when the judgement result of step SPg4 is "YES", the processing proceeds to step SPg5 wherein the value of the register CST[i] is re-written by "3". In a next step SPg6, the key-off signal KOFP is sent to the No. i channel of the musical tone synthesizing circuit 10 so as to suspend the generation of the musical tone. After executing this process of step SPg6, the processing returns to step SPg3 via steps SPg7, SPg8. The above-mentioned processes of steps SPg3 through SPg7 are carried out with respect to all of the channels corresponding to i=0~29. When the value of the register i reaches "30", the judgement result of step SPg8 turns to "YES", and then the processing returns back to the main routine. Due to the processes of this subroutine, when the depressed sustaining pedal is released, the generation of the musical tone which is sustained in the sustaining duration is suspended.

(5) End-Channel Detecting Process

FIG. 10 shows the subroutine of the end-channel detecting process. In a first step SPh1, the value of the register i is set at "0". In a next step SPh2, data IFFFH is written into a register MIN. This register MIN stores a reference value used for searching the musical tone of which the envelope is the smallest among the generating musical tones. In a next step SPh3, an envelope value set in the No. i channel of the musical tone synthesizing circuit 10 is written into a register ENV[i]. The envelope value representing the amplitude of the envelope waveform is gradually reduced in the waveform portion following the attack portion. In step SPh3, the envelope value at the current timing is written in.

Next, the processing proceeds to step SPh4 wherein it is judged whether or not the envelope value stored in the register ENV[i] is smaller than the predetermined small value TH. This value TH corresponds to the small envelope value of which level is negligible so that its generating sound can be presumed as the sound to be muted. If the judgement result of this step SPh4 is "YES", it is possible to presume that the sound is muted. Thus, the processes of steps SPh5 through SPh8 will be carried out.

In a step SPh5, "0" is set to the register CST[i], so that the current channel is declared as the unoccupied channel. In a next step SPh6, the current value of the register i is written into a register ACH which is provided to temporarily store the channel number. In a step SPh7, the CPU 1 performs a releasing operation on an assigning-channel buffer. This operation is constructed by steps as shown in FIG. 11. In a step SPi1 of FIG. 11, the value of the register ACH is written into an assigning buffer ASNB[ASN·WP]. Herein, "ASN·WP" indicates a write-in pointer for the assigning buffer, which designates the write-in point (or address) of the assigning buffer. Therefore, "ASNB[ASN·WP]" designates the memory area of the assigning buffer which is designated by the foregoing write-in pointer. In order to immediately assign the unoccupied channel for the musical tones for which a tone-generation request has occurred, the assigning buffer ASNB is constructed in the form of the ring buffer. In a next step SPi2, a calculation of "(ASN·WP+1)mod30" is performed. In this calculation, the value of the pointer ASN·WP is added with "1", and the addition result is divided by "30" so as to calculate the remainder. This remainder is written into the pointer ASN·WP. Due to the above-mentioned calculation, the value of the pointer ASN·WP will designate the next write-in point of the assigning buffer ASNB.

After executing the above-mentioned releasing operation as shown in FIG. 11, the processing proceeds to step SPh8 shown in FIG. 10 wherein the value of the register ASCN is decremented by "1". This register ASCN stores the number of the channels which are occupied at the current timing. Due to the above-mentioned releasing operation of step SPh7, one of the occupied channels is treated as the unoccupied channel. For this reason, the value of the register ASCN is reduced in step SPh8.

On the other hand, when the judgement result of step SPh4 is "NO". the processing directly branches to step SPh9 wherein it is judged whether or not the value of the register EVN[i] is smaller than that of the register MIN. If the judgement result of this step SPh9 is "NO", the processing jumps to step SPh12 wherein the value of the register i is incremented by "1". Then, the processing returns to step SPh3 again via step SPh13. On the other hand, if the judgement result of step SPh9 is "YES", the processing proceeds to step SPh10 wherein the value of the register ENV[i] is written into the register MIN. Thus, the value of the register MIN is re-written by a smaller value. In next step SPh11, the value of the register i is memorized in a register EMC. After executing the process of step SPh11, the processing returns to step SPh3 again via steps SPh12, SPh13.

The above-mentioned processes of steps SPh3 through SPh13 is repeatedly performed with respect to i=0~29. When i reaches "30", the judgement result of step SPh13 turns to "YES", so that the processing returns to the main routine. Due to the above-mentioned processes of this subroutine, when the CPU 1 finds the channel of which generating sound can be presumed as the sound to be muted, the processes of steps SPh5 through SPh8 are executed so that the tone generation is suspended and such channel is memorized as the unoccupied channel. In this case, "0" is set to the register MIN which is designed to store the smallest envelope value. On the other hand, if all of the channels are occupied with the tone generation, the register MIN stores the smallest one of the envelope values, while the register EMC stores the number of the channel of which the envelope value is the smallest.

(2) Detailed Description of Key Process

Next, detailed description will be given with respect to the key process.

(1) Key-On Process

The subroutine of the key-on process is constructed by steps shown in FIG. 12. In a first step SPj1, it is judged whether or not a value of a register KONC is equal to "16". This register KONC stores the number of the channels which are in the key-on state at the current timing. The present embodiment sets the maximum number of the channels of which sounds can be simultaneously produced in the manual performance at "16". In general, a maximum of ten sounds can be designated by ten fingers of the performer. However, some sounds can be continuously produced under the sustaining effect which is activated by depressing the sustaining pedal, so that the number of the sounds which can be simultaneously produced can be increased more than ten. But, if the manual performance occupies so many channels, there occurs a drawback in that the automatic accompaniment must be subjected to the restriction and it may lack a smoothness in performance. For this reason, the present embodiment sets the maximum number of the sounds which can be simultaneously produced in the manual performance at "16". Thus, when the judgement result of step SPj1 is "YES", the processing directly returns to the main routine without substantially executing any processes of this subroutine.

On the other hand, if the judgement result of step SPj1 is "NO", the processing proceeds to step SPj2 wherein a key-on buffer assignment process is carried out. The subroutine of this process is constructed by steps shown in FIG. 13. In a first step SPk1 of FIG. 13, the register i is cleared. In a next step SPk2, it is judged whether or not the value of the key-on buffer KOKC[i] is equal to zero. Herein, there are provided plural key-on buffers KOKC[i] (where i="0"~"15"), wherein some of them for which the key-on event has occurred store the keycodes, while the others store the value "0". If the judgement result of step SPk2 is "NO", the processing proceeds to step SPk3 wherein the value of the register i is incremented by "1". Then, the processing returns to the foregoing step SPk2 again via step SPk4. Thereafter, until the judgement result of step SPk2 turns to "YES", the above-mentioned processes of steps SPk2 through SPk4 are repeatedly performed. In the case where the judgement result of step SPk2 is still at "NO" even when the value of the register i reaches "15", this value is incremented to "16" in step SPk3 so that the judgement result of step SPk4 turns to "YES". Thus, the processing proceeds to step SPk5 wherein a flag FIND is set at "0", and then the processing returns to the main routine.

On the other hand, if the judgement result of step SPk2 turns to "YES" before the value of the register i reaches "15", the processing branches to step SPk6 wherein a keycode KC representing the depressed key is stored in the key-on buffer KOKC[i]. In a next step SPk7, the value of the register i is put in a register SCH. In step SPk8, the flag FIND is set at "1". Then, the processing returns to the foregoing key-on process shown in FIG. 12.

After completing the above-mentioned key-on buffer assignment process, the processing proceeds to step SPj3 shown in FIG. 12 wherein the value of the register KONC is incremented by "1". In a step SPj4, it is judged whether or not the value of the register ASCN is equal to "30". If the judgement result of step SPj4 is "NO", the processing directly jumps to step SPj8 wherein an assigning-channel-buffer assigning process is made so that one or more channels are assigned with the tone generation. Incidentally, the register ASCN stores the number of the sounds which are assigned to the sound source. Therefore, if the value of this register is less than thirty, there must be one or more unoccupied channels to which the assigning operation can be performed.

In contrast, when the judgement result of step SPj4 is "YES", the processing proceeds to step SPj5 wherein "0" is set to a register TYPE. In a next step SPj6, a truncate process is carried out. Like the foregoing register CTYPE, this register TYPE is set with the value "0" in the manual performance, while it is set with the value "1" in the automatic accompaniment.

The subroutine of the above-mentioned truncate process is constructed by steps shown in FIG. 14. In a first step SPm1 of FIG. 14, it is judged whether or not the value of the register TYPE is equal to "0". In other words, it is judged whether or not the manual performance is designated. If the processing reaches the truncate process as shown in FIG. 14 via step SPj5, the register TYPE must be set at "0", so that the judgement result of step SPm1 is turned to "YES". Thus, the processing proceeds to step SPm2 wherein a signal DAMP is sent to the channel, of which the number is designated by the register EMC, in the musical tone synthesizing circuit 10. As described before, this register EMC memorizes the number of the channel of which the envelope is the smallest. Then, the channel receiving the signal DAMP rapidly damps the tone volume of the musical tone. In a next step SPm3, the value of the register EMC is transferred to the register ACH. In a step SPm4, the assigning-channel-buffer releasing process is carried out. This process has been described before by referring to FIG. 11. Due to this process, the channel of which the musical tone is damped in step SPm2 is written into the assigning buffer ASNB[ASN·WP] as the unoccupied channel.

After executing the above-mentioned process of step SPm4, the processing returns to the foregoing key-on process shown in FIG. 12 and then proceeds to step SPj7 wherein the value of the register ASCN is decremented by "1". In a next step SPj8, the assigning-channel-buffer assigning process is carried out. Herein, the subroutine of this process is constructed by steps shown in FIG. 15. In a first step SPn1, the channel number stored in the assigning buffer ASNB[ASN·RP] is written into the register ACH. Herein, "ASN·RP" designates a read-out pointer for the assigning buffer, which indicates a read-out point of the assigning buffer. Therefore, "ASNB[ASN·RP]" designates a memory area designated by the pointer in the assigning buffer ASNB. In a next step SPn2, a calculation of "(ASN·RP+1-)mod30" is carried out. More specifically, the value of the pointer ASN·RP is added with "1", and the addition result is divided by "30" so as to compute the remainder. This remainder is written into the pointer ASN·RP as its new value. Due to this calculation, the new value of the pointer ASN·RP designates the next read-out point of the assigning buffer ASNB. Incidentally, the value of the pointer must be incremented by "1" because of the configuration of the assigning buffer ASNB which is constructed as the ring buffer.

Then, the processing returns to the key-on process shown in FIG. 12 wherein it proceeds to step SPj9. In the step SPj9, the value of the register ACH is written into the register CH. As described before, the register CH temporarily stores the channel number. Thus, the number of the channel to be assigned with the tone generation is written into this register CH. Since the number of the channels which are assigned with the tone generation is increased by "1", the value of the register ASCN is incremented by "1" in step SPj10. In a next step SPj11, the value "0" representing the manual performance is written into the register CTYPE[CH]

(where the value CH has been set in the foregoing step SPj9). In addition, the value "0" is written into the register CTR[CH] as the dummy data. Herein, this register CTR[CH] is originally designed to store the track number of the automatic accompaniment. However, in case of the manual performance, it is necessary to write the dummy data into this register. Further, the value "1" representing the key-on event is written into the register CST[CH], while the value of the keycode register KC (i.e., keycode of the depressed key) is written into the register CKC[CH]. Thereafter, the processing proceeds to step SPj12 wherein the keycode stored in the keycode register KC, key-depressing velocity data stored in the register KV, tone-color number data stored in the register TC and key-on signal KONP are sent to a No. CH channel (i.e., channel of which the number is designated by the register CH). Thus, it is possible to start generating the musical tone with respect to the depressed key.

As described above, the tone generation of the depressed key is performed. Even if all of the channels are occupied, the tone generation of the key which is newly depressed in the manual performance is assigned to the channel of which the envelope is the smallest, so that the musical tone of the manually depressed key is generated from this channel.

② Key-Off Process (or KOFF Process)

The subroutine of the key-off process is constructed by steps shown in FIG. 16. In a first step SPq1, a key-on-buffer releasing process is carried out. This process is further constructed by steps shown in FIG. 17. In a first step SPr1 of FIG. 17, the register i is cleared. In a next step SPr2, it is judged whether or not the value of the keycode register KC (i.e., keycode of the released key) is written into the key-on buffer KOKC[i]. If the judgement result of step SPr2 is "NO", the processing proceeds to step SPr3 wherein the value of the register i is incremented by "1". Then, the processing returns to the foregoing step SPr2 via step SPr4. Thereafter, the above-mentioned processes of steps SPr2 through SPr4 are repeatedly performed until the judgement result of step SPr2 turns to "YES". In the case where the judgement result of step SPr2 remains at "NO" even when the value of the register i becomes equal to "15", this value is increased to "16" in step SPr3 so that the judgement result of step SPr4 turns to "YES". Therefore, the processing proceeds to step SPr5 wherein "0" is set to the flag FIND, and then the processing returns to the foregoing key-off process shown in FIG. 16. The above-mentioned case where the judgement result of step SPr2 remains at "NO" even when the value of the register i reaches "15" must occur under the condition where the present system cannot respond to the new key-on event so that its keycode cannot be assigned to the key-on buffer (see foregoing steps SPj1, SPj2).

On the other hand, when the judgement result of step SPr2 turns to "YES" before the value of the register i reaches "15", the processing branches to step SPr6 wherein the value of the key-on buffer KOKC[i] is set at "0". In a next step SPr7, the flag FIND is set at "1". Thereafter, the processing returns to the foregoing key-off process shown in FIG. 16.

After completing the above-mentioned key-on buffer releasing process, the processing proceeds to step SPq2 shown in FIG. 16 wherein it is judged whether or not the flag FIND is equal to "1". If the judgement result of step SPq2 is "NO", the processing returns to the main routine without substantially executing any processes of this subroutine. This is because when the flag FIND is at "0", it is presumed that the keycode of the key on which the key-off event has occurred does not exist in the key-on buffer and consequently the tone generation of such key is not performed at all.

If the judgement result of step SPq2 is "YES", the processing proceeds to step SPq3 wherein the value of the register KONC representing the number of the key-on channels at the current timing is decremented by "1". In a next step SPq4, the value "0" representing the manual performance is written into the register TYPE, while the dummy data "0" is written into the register TR whose value represents the number of the track of the automatic accompaniment. In a step SPq5, a key-off-channel searching process is carried out.

The above process of step SPq5 is further constructed by steps shown in FIG. 18. In a first step SPs1 of FIG. 18, the register i is cleared. In a next step SPs2, it is judged whether or not the value of the register CST[i] is equal to "0", or in other words, it is judged whether or not the No. i channel is the unoccupied channel. If the judgement result of step SPs2 is "NO", the processing proceeds to step SPs3 wherein it is judged whether or not the keycode stored in the register CKC[i] coincides with the contents of the keycode register KC (representing the keycode of the key on which the key-off event is occurred). If the judgement result of step SPs3 is "YES", the processing proceeds to step SPs4 wherein it is judged whether or not the contents of the register CTR[i] coincide with the value of the register TR. Since the dummy data "0" representing the manual performance is written into the register TR in the foregoing step SPq4, the judging process of step SPs4 is provided to judge whether or not the manual performance is designated. If the judgement result of this step SPs4 is "YES", the processing proceeds to step SPs5 wherein it is judged whether or not the value of the register CTYPE[i] coincides with the value of the register TYPE. Since the value "0" is written into the register TYPE in the foregoing step SPq4, the judging process of this step SPs5 is also provided to judge whether or not the manual performance is designated. If the judgement result of step SPs5 is "YES", the processing proceeds to step SPs6 wherein the value of the register i is written into the register SCH. In a step SPs7, "1" is set to the flag FIND. Then, the processing returns to the foregoing key-off process wherein it proceeds to step SPq6.

In order to reach the step SPs6 in FIG. 18, the judgement result of step SPs2 is at "NO", and the judgement results of steps SPs3, SPs4, SPs5 are all at "YES". In the processes of steps SPs2 through SPs5, the CPU 1 finds one of the occupied channels which is in the manual-performance mode and which has the keycode of the key-off key.

In contrast, when the judgement result of step SPs2 turns to "YES", or when any one of the judgement results of steps SPs3 through SPs5 turns to "NO", the processing jumps to steps SPs8 wherein the value of the register i is incremented by "1". Then, the processing returns to the foregoing step SPs2 again via step SPs9. Thereafter, the processes of steps SPs2 through SPs5, SPs8 and SPs9 are repeatedly performed. In the case where the processing cannot proceed to step SPs6 before the value of the register i reaches "30", the judgement result of step SPs9 turns to "YES" so that the processing proceeds to step SPs10 wherein the flag FIND is set at "0". Then, the processing returns to the foregoing key-off process shown in FIG. 16 wherein it further proceeds to step SPq6.

In the step SPq6, it is judged whether or not the flag FIND is equal to "1". If the judgement result of step SPq6 is "YES", the processing returns to the main routine without executing the remaining processes of this subroutine. This is because when the subroutine of FIG. 17 fails to find out the channel, it is presumed that the tone generation is not performed. In other words, it is not necessary to perform the key-off process (see step SPq11) again.

If the judgement result of step SPq6 is "YES", the processing proceeds to step SPq7 wherein the contents of the register SCH (i.e., the value of the register i which is written into the register SCH in the foregoing step SPs6 shown in FIG. 18) is written into the register CH. In a next step SPq8, it is judged whether or not the flag PONF is equal to "0". The value of this flag PONG is turned to "1" when the sustaining pedal is depressed. If the judgement result of step SPq8 is "NO", the processing proceeds to step SPq9 wherein the value "2" representing the sustaining condition of the sound is written into the register CST[CH]. In this case, the value of the register CH represents the number of the channel concerning the key on which the key-off event is occurred (see steps SPs6, SPq7). On the other hand, if the judgement result of step SPq8 is "YES", the processing branches to step SPq10 wherein the value "3" representing the key-off event is written into the register CST[CH]. In a next step SPq11, the key-off signal KOFP is sent to the No.CH channel so as to suspend the tone generation.

(3) Detailed Description of Automatic-Accompaniment Process

Next, a detailed description will be given with respect to the automatic-accompaniment process which is divided into the note-on process and note-off process.

① Note-On Process

The subroutine of this note-on process is constructed by steps shown in FIG. 19. In a first step SPt1, it is judged whether or not the value of the register ASCN is equal to "30". In other words, it is judged whether or not all of the channels are occupied. If the judgement result of step SPt1 is "NO", the processing jumps to step SPt6 wherein the assigning-channel-buffer assigning process (which is described by referring to FIG. 15) is carried out. Then, the processing proceeds to step SPt7 wherein the value of the register ACH is written into the register CH. In other words, the number of the channel to be assigned is written into the register CH. Since the number of the channels which are assigned with the tone generation is increased by "1", the value of the register ASCN is incremented by "1" in step SPt8. In a next step SPt9, the value "1" representing the automatic accompaniment is written into the register CTYPE[CH], wherein the value CH has been set in the foregoing step SPt7. In addition, the track number TR of the automatic accompaniment to be played is written into the register CTR[CH]; the value "1" representing the key-on event is written into the register CST[CH]; and the value of the note code register NC is written into the register CKC[CH]. In a step SPt11, the note code of the designated register NC, key-depressing velocity data of the register KV, tone-color-number data of the register ATC and key-on signal KONP are sent to No.CH the channel of the musical tone synthesizing circuit shown in FIG. 1. Thus, generation of the musical tones which are designated by the automatic accompaniment is started.

In contrast, when the judgement result of step SPt1 is "YES", the processing proceeds to step SPt2 wherein the value "1" representing the automatic accompaniment is set to the register TYPE. In a next step, SPt3, the foregoing truncate process is carried out. This truncate process has already been described in conjunction with FIG. 14. In the case where the truncate process is carried out after completing the process of step SPt2, the processing proceeds from step SPm1 to step SPm5 shown in FIG. 14 wherein an automatic-accompaniment-key-off searching process is carried out.

The subroutine of the automatic-accompaniment-key-off searching process is constructed by steps shown in FIG. 20. In a first step SPu1 of FIG. 20, the register i is cleared. In a next step SPu2, the data IFFFH is written into the register MIN storing the reference value by which the minimum envelope value is to be searched. This data IFFFH is set as the dummy data the value of which is originally set at the maximum value of the present embodiment. In a step SPu3, the flag FIND is reset. Then, the judging processes of steps SPu4 through SPu6 are carried out. In a step SPu4, it is judged whether or not the value of the register CTYPE[i] is equal to "1". In other words, it is judged whether or not the sounds of the automatic accompaniment are to be generated. In a step SPu5, it is judged whether or not the value of the register CST[i] is equal to "3". In other words, it is judged whether or not the key-off command is given. In a step SPu6, it is judged whether or not the value of the register ENV[i] is smaller than the value of the register MIN. In other words, it is judged whether or not the envelope value of No.i channel is smaller than the reference value stored in the register MIN. If all of the judgement results of steps SPu4 through SPu6 are "YES", the CPU 1 selects the channel to which the key-off command is sent during the automatic accompaniment and of which the envelope value is smaller than the reference value stored in the register MIN. Therefore, in a next step SPu7, the envelope value of the selected channel (i.e., ENV[i]) is written into the register MIN as its new reference value. In a step SPu8, the flag FIND is set at "1".

When the process of the step SPu8 is completed, or when any one of the judgement results of the steps SPu4 through SPu6 turns to "NO", the processing jumps to step SPu9 wherein the value of the register i is incremented by "1". Then, the processing returns to the foregoing step SPu4 via step SPu10. Thereafter, the above-mentioned processes of steps SPu4 through SPu10 are repeatedly performed until the value of the register i reaches "30". Due to these processes, every time the CPU 1 determines the channel to which the key-off command is sent during the automatic accompaniment, the envelope value of such channel is compared to the reference value of the register MIN. When the envelope value is smaller than the reference value, it is written into the register MIN as its new reference value. Thus, at a time when all of the processes of this subroutine are completed, the register MIN stores the smallest one of the envelope values of the automatic-accompaniment sounds which are continuously produced after receiving the key-off command. Incidentally, if any one of the judgement results of steps SPu4 through SPu6 turns to "NO" with respect to all of the channels (i.e., i="0"~"29"), the processing returns to the foregoing truncate process shown in FIG. 14 while maintaining the value of the flag FIND at "0".

When completing the above-mentioned automatic-accompaniment-key-off searching process, the processing proceeds to step SPm6 shown in FIG. 14 wherein it is judged whether or not the flag FIND is set at "1". If the judgement result of step SPm6 is "NO", the processing proceeds to step SPm7 wherein a sustaining-key-off searching process is carried out.

The subroutine of the sustaining-key-off searching process is constructed by steps shown in FIG. 21. This sustaining-key-off searching process shown in FIG. 21 is similar to the foregoing automatic-accompaniment-key-off searching process shown in FIG. 20, wherein steps SPv1 through SPv10 roughly correspond to the foregoing steps SPu1 through SPu10. Unlike the foregoing process, step SPv4 judges whether or not the sounds of the manual performance are to be generated, while step SPv5 judges whether or not the channel is in the sustaining duration. Therefore, every time the CPU 1 determines the channel which is in the sustaining duration of the manual performance, the envelope value of such channel is compared to the reference value of the register MIN in step SPv6. Then, if the envelope value is smaller than the reference value, it is stored in the register MIN as its new reference value in step SPv7. Thus, the channel number "i" is memorized in the register SCH. Incidentally, if any one of the judgement results of steps SPv4 through SPv6 turns to "NO" with respect to all of the channels (i.e., i="0"~"29"), the processing returns to the foregoing truncate process shown in FIG. 14 while maintaining the value of the flag FIND at "0".

When completing the sustaining-key-off searching process, the processing proceeds to step SPm8 shown in FIG. 14 wherein it is judged whether or not the flag FIND is set at "1". When the judgement result of step SPm8 is "YES", or when the foregoing judgement result of step SPm6 is "YES", the processing proceeds to step SPm9 wherein the channel number stored in the register SCH is written into the register CH. In a next step SPm10, the signal DAMP is sent to the No.SCH channel within the musical tone synthesizing circuit 10. As a result, the tone volume of the musical tone generated from the channel receiving the signal DAMP must be rapidly damped. In a step SPm11, the channel number of the register SCH is stored in the register ACH. In a step SPm12, the foregoing assigning-channel-buffer releasing process as shown in FIG. 11 is carried out. After completing this process, the processing returns to the foregoing note-on process shown in FIG. 19. In FIG. 19, the processes of steps SPt4, SPt5 and SPt6 through SPt11 are carried out, so that the musical tone corresponding to the note-on code is generated from the channel whose previous sounding operation is muted.

Meanwhile, when the foregoing judgement result of step SPm8 shown in FIG. 14 is "NO", the processing returns to the note-on process shown in FIG. 19 wherein it proceeds to step SPt4. In this case, the judgement result of step SPt4 also turns to "NO", so that the processing returns back to the foregoing main routine without executing the remaining processes of this subroutine shown in FIG. 19.

The note-on process as described heretofore can be summarized as follows:

In the case where the new note-on event of the automatic accompaniment occurs under the condition where all of the channels are occupied with the tone generation (hereinafter, simply referred to as "full-channel condition"), the present embodiment mutes the automatic-accompaniment sound produced from the channel whose envelope value is the smallest. In this case, if such channel cannot be found, the present embodiment mutes the manual-performance sound produced from the channel which continues to sustain the tone generation after receiving the key-off command. Then, the automatic-accompaniment sound corresponding to the note-on code is produced from such channel whose sound is muted as described above. Meanwhile, if no channel whose sound can be muted can be found, the present embodiment neglects the note-on code so as not to execute the tone-generation process for the note-on code.

(2) Note-Off Process

Next, description will be given with respect to the note-off process of the automatic accompaniment. The subroutine of this process is constructed by steps shown in FIG. 22. In a first step SPw1, the value of the note-code register NC is written into the register KC, while the value "1" representing the automatic accompaniment is written into the register TYPE. After executing this process of step SPw1, the processing proceeds to step SPw2 wherein the foregoing key-off-channel searching process as shown in FIG. 18 is carried out. In this step SPw2, it is judged whether or not there exists the channel on which the key-off event has truly occurred. Then, the flag FIND is set at "1" when the judgement result is true, while the flag FIND is set at "0" when the judgement result is false.

Thereafter, the processing proceeds to a step SPw3 wherein it is judged whether or not the flag FIND is set at "1". If the judgement result of step SPw3 is "NO" there is no need to perform the note-off process. Therefore, the processing returns to the foregoing automatic-accompaniment process shown in FIG. 7 without executing the remaining processes of this subroutine. On the other hand, if the judgement result of step SPw3 is "YES", the processing proceeds to step SPw4 wherein the channel number stored in the register SCH is written into the register CH. In next step SPw5, the value "3" representing the key-off command is written into the register CST[CH]. In a step SPw6, the key-off signal KOFP is sent to the No.CH channel of the musical tone synthesizing circuit 10 so as to suspend its tone generation.

[C] Effects and Modifications

The overall operation of the present embodiment can be classified into the four processes in response to four events as follows:

(1) First Event

In the first event where a new manual-performance sound is entered under the full-channel condition where all of the channels are occupied with the tone generation, the present embodiment detects the channel whose envelope value is the smallest, and then the new manual-performance sound is assigned to the detected channel.

(2) Second Event

In the second event where a new automatic-accompaniment sound is entered under the full-channel condition where all of the channels are occupied with the tone generation, the present embodiment detects the channel, assigned with the tone generation of the automatic accompaniment, whose envelope value is the smallest and which receives the key-off command. Then, the new automatic-accompaniment sound is assigned to the detected channel.

③ Third Event

In the third event where the present embodiment cannot determine the corresponding channel in the second event, the present embodiment detects the channel which receives the key-off command but sustains the tone generation for the manual performance. Then, the new automatic-accompaniment sound is assigned to the detected channel.

④ Fourth Event

In the fourth event where the present embodiment cannot determine the corresponding channel in the third event, the present embodiment neglects the tone-generation request of the new automatic-accompaniment sound.

As described heretofore, the present embodiment performs the above four processes respectively in response to the four events. Therefore, even if all of the channels are occupied with the tone generation, the priority is given to the manual-performance sounds so that sixteen or less manual-performance sounds can be simultaneously produced. In other words, all of the manually performed sounds can be produced, so that the performer can smoothly play the manual performance without being intercepted by the tone-generation request for the automatic accompaniment.

As for the automatic-accompaniment sound which is newly entered under the full-channel condition, this new automatic-accompaniment sound is assigned to the channel, occupied with the tone generation of the automatic accompaniment, which receives the key-off command and whose envelope value is the smallest. Thus, it is possible to play the automatic accompaniment naturally. If such channel assignment fails to be made well, the automatic-accompaniment sound is assigned to the channel, occupied with the tone generation of the manual performance, which receives the key-off command but sustains the tone generation of the manual performance. For this reason, it is possible to play the automatic accompaniment smoothly without causing the un-natural sounding manner.

The present embodiment can be modified such that only the processes corresponding to first, second and third events, or processes corresponding to first, second and fourth events are selected. If the channel-assignment precision for the new automatic-accompaniment sound can be reduced under the full-channel condition, the above-mentioned process corresponding to the third or fourth event can be omitted.

In order to achieve all of the above-mentioned processes, it is possible to change the processing priority such that the process of the fourth event is performed before performing the process of third event.

Lastly, this invention may be practiced or embodied in still other ways without departing from the spirit or essential character thereof as described heretofore. For example, the scope of the invention is not limited to the automatic-accompaniment playing operation but it can be further applied to the automatic-performance playing operation. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument, comprising:

automatic-performance means for designating an automatic-performance sound when carrying out an automatic performance on the basis of pre-stored automatic-performance information;

manual-performance means for designating a manual-performance sound in accordance with a performance manually made by a performer;

a plurality of channels from which said automatic-performance sound and/or said manual-performance sound are generated;

searching means for searching an unoccupied channel within said plurality of channels which is not occupied with a tone generation;

assignment means for assigning a new musical tone to said unoccupied channel which is searched by said searching means, so that the new musical tone is generated from said unoccupied channel;

first assignment means, which is activated when a new manual-performance sound is designated under a full-channel condition where all of said plurality of channels are occupied with the tone generation, for detecting a channel having an envelope value which is the smallest among said plurality of channels, so that the new manual-performance sound is assigned to the detected channel; and second assignment means, which is activated when a new automatic-performance sound is designated under the full-channel condition, for detecting a channel which receives a key-off command and having an envelope value which is the smallest among the channels occupied with the tone generation of the automatic-performance sounds, so that the new automatic-performance sound is assigned to the detected channel.

2. An electronic musical instrument, comprising:

automatic performance means for designating an automatic-performance sound when carrying out an automatic performance on the basis of pre-stored automatic-performance information;

manual-performance means for designating a manual-performance sound in accordance with a performance manually made by a performer;

a plurality of channels from which said automatic-performance sound and/or said manual-performance sound are generated;

searching means for searching an unoccupied channel within said plurality of channels which is not occupied with a tone generation;

assignment means for assigning a new musical tone to said unoccupied channel which is searched by said searching means, so that the new musical tone is generated from said unoccupied channel;

first assignment means, which is activated when a new manual-performance sound is designated under a full-channel condition where all of said plurality of channels are occupied with the tone generation, for detecting a channel having an envelope value which is the smallest among said plurality of channels, so that the new manual-performance sound is assigned to the detected channel; and second assignment means, which is activated when a new automatic-performance sound is designated under the full-channel condition, for detecting a channel which receives a key-off command but sustains to generate the manual-performance sound among the channels occupied with the tone generation of the manual-performance sounds, so that the new channel-performance sound is assigned to the detected channel.

3. An electronic musical instrument, comprising:

automatic-performance means for designating an automatic-performance sound when carrying out an automatic performance on the basis of pre-stored automatic-performance information;

manual-performance means for designating a manual-performance sound in accordance with a performance manually made by a performer;

a plurality of channels from which said automatic-performance sound and/or said manual-performance sound are generated;

searching means for searching an unoccupied channel within said plurality of channels which is not occupied with a tone generation;

assignment means for assigning a new musical tone to said unoccupied channel which is searched by said searching means, so that the new musical tone is generated from said unoccupied channel;

first assignment means, which is activated when a new manual-performance sound is designated under a full-channel condition where all of said plurality of channels are occupied with the tone generation, for detecting a channel having an envelope value which is the smallest among said plurality of channels, so that the new manual-performance sound is assigned to the detected channel;

second assignment means, which is activated when a new automatic-performance sound is designated under the full-channel condition, for detecting a channel which receives a key-off command and having an envelope value which is the smallest among the channels occupied with the tone generation of the automatic-performance sounds, so that the new automatic-performance sound is assigned to the detected channel;

third assignment means, which is activated when said second assignment means fails to detect said channel, for detecting a channel which receives the key-off command but sustains to generate the manual-performance sound among the channels occupied with the tone generation of the manual-performance sounds, so that the new automatic-performance sound is assigned to the detected channel; and assignment control means, which is activated when said third assignment means fails to detect said channel, for neglecting a tone-generation request for the new automatic-performance sound, so that the new automatic-performance sound is not actually generated.

4. An electronic musical instrument, comprising:

automatic-performance means for designating an automatic-performance sound when carrying out an automatic performance on the basis of pre-stored automatic-performance information;

manual-performance means for designating a manual-performance sound in accordance with a performance manually made by a performer;

a plurality of channels from which said automatic-performance sound and/or said manual-performance sound are generated;

searching means for searching an unoccupied channel within said plurality of channels which is not occupied with a tone generation;

detecting means for detecting whether or not said searching means fails to search out said unoccupied channel, so that said detecting means declares a full-channel condition when all of said plurality of channels are occupied with the tone generation;

assignment means, which is activated when said detecting means does not declare the full-channel condition, for assigning a new musical tone to said unoccupied channel which is searched by said searching means, so that the new musical tone is generated from said unoccupied channel;

manual-performance assignment means, which is activated when a new manual-performance sound is designated under the full-channel condition, for detecting a channel having an envelope value which is the smallest among said plurality of channels, so that the new manual-performance sound is assigned to the detected channel;

first automatic-performance assignment means, which is activated when a new automatic-performance sound is designated under the full-channel condition, for detecting one of the channels occupied with the tone generation of the automatic-performance sounds which receives a key-off command and having an envelope value which is the smallest, so that the new automatic-performance sound is assigned to the detected channel; and second automatic-performance assignment means, which is activated when said first automatic-performance assignment means fails to detect said channel, for detecting one of the channels occupied with the tone generation of the manual-performance sounds which receives the key-off command sustains to generate the manual-performance sound, so that the new automatic-performance sound is assigned to the detected channel.

5. An electronic musical instrument as defined in any one of the claims 1 to 4, wherein said manual-performance means is comprised of a keyboard which is manually played by the performer.

6. An electronic musical instrument as defined in any one of the claims 1 to 4, wherein said automatic-performance means includes a memory which memorizes said automatic-performance information in advance.

7. A channel-assignment method employed in an electronic musical instrument in which a manual-performance sound or an automatic-performance sound is assigned to one of a plurality of channels, said channel-assignment method comprising the steps of:

searching an unoccupied channel which is not occupied with a tone generation within said plurality of channels;

assigning a new musical tone to said unoccupied channel;

detecting a full-channel condition where all of said plurality of channels are occupied with the tone generation;

performing a manual-performance assignment when a new manual-performance sound is designated under the full-channel condition, thereby assigning the new manual performance sound to one of said plurality of channels which satisfies a first channel-selection condition, said first channel-selection condition selecting a channel having an envelope value which is the smallest among said plurality of channels; and performing an automatic-performance assignment when a new automatic-performance sound is designated under the full-channel condition, thereby assigning the new automatic-performance sound to one of said plurality of channels which satisfies a second channel-selection condition, said second channel-selection condition selecting a channel which receives a key-off command and having an envelope value which is the smallest among the channels occupied with the tone generation of the automatic-performance sounds.

8. An electronic musical instrument, comprising:

automatic-performance means for designating an automatic-performance sound when carrying out an automatic performance on the basis of pre-stored automatic-performance information;

manual-performance means for designating a manual-performance sound in accordance with a performance manually made by a performer;

a plurality of channels from which said automatic-performance sound and/or said manual-performance sound are generated;

searching means for searching an unoccupied channel within said plurality of channels which is not occupied with a tone generation;

first assignment means for assigning a new musical tone to said unoccupied channel which is searched by said searching means, so that the new musical tone is generated from said unoccupied channel; and second assignment means, which is activated when a tone-generation request for the new musical tone is given under a full-channel condition where all of said plurality of channels are occupied with the tone generation, for selecting one of said channels in accordance with a predetermined priority order so as to perform a truncate process on the selected channel so that its generating sound is muted, thus assigning a tone generation of the new musical tone to the selected channel.

* * * * *